US007549550B2

(12) United States Patent
Smyers et al.

(10) Patent No.: US 7,549,550 B2
(45) Date of Patent: Jun. 23, 2009

(54) COLLAPSIBLE CONTAINER

(75) Inventors: Justin M. Smyers, San Luis Obispo, CA (US); William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 743 days.

(21) Appl. No.: 11/110,360

(22) Filed: Apr. 19, 2005

(65) Prior Publication Data

US 2006/0231555 A1 Oct. 19, 2006

(51) Int. Cl.
*B65D 6/18* (2006.01)
*B65D 90/08* (2006.01)

(52) U.S. Cl. ..... 220/6; 220/691

(58) Field of Classification Search ..... 220/6, 220/7, 691

See application file for complete search history.

(56) References Cited

U.S. PATENT DOCUMENTS

| | | | | |
|---|---|---|---|---|
| 6,239,418 | B1 * | 5/2001 | Konig et al. | 219/756 |
| 6,722,516 | B1 * | 4/2004 | Zelko | 220/7 |
| 7,017,766 | B2 * | 3/2006 | Hsu et al. | 220/7 |
| 7,264,122 | B2 * | 9/2007 | Koefelda et al. | 206/600 |
| 7,281,637 | B2 * | 10/2007 | Hadar | 220/6 |
| 2003/0116564 | A1 * | 6/2003 | Overholt et al. | 220/7 |
| 2003/0136781 | A1 * | 7/2003 | Rumpel | 220/6 |
| 2004/0069780 | A1 | 4/2004 | Apps et al. | |
| 2004/0159659 | A1 * | 8/2004 | Rumpel | 220/7 |
| 2004/0178197 | A1 * | 9/2004 | Hsu et al. | 220/7 |
| 2005/0121447 | A1 * | 6/2005 | Barth | 220/6 |
| 2005/0155967 | A1 * | 7/2005 | Vial | 220/6 |
| 2005/0194382 | A1 * | 9/2005 | Vial | 220/7 |

FOREIGN PATENT DOCUMENTS

EP 1437306 7/2004

OTHER PUBLICATIONS

United Kingdom Search Report, Jul. 25, 2006.

* cited by examiner

*Primary Examiner*—Anthony D Stashick
*Assistant Examiner*—Niki M Eloshway
(74) *Attorney, Agent, or Firm*—Carlson, Gaskey & Old

(57) ABSTRACT

A collapsible container includes a plurality of collapsible walls, each pair of adjacent walls connected by a latch. Each latch can be selectively actuated from contact with the latch both from inside and the outside of the container, and further by inwardly directed forced to the outside of the wall first to collapse. Preferably, the latch includes a recess into which the adjacent wall is disposed when the latch is in the latched position. Preferably, the latch is unlatched by flexing the latch away from the adjacent wall by application of force on an inner release surface, inward of the recess or by actuation of an outer release surface, outward of the recess, or by the application of an inwardly directed forced to the walls that are first to collapse.

26 Claims, 24 Drawing Sheets

COLLAPSIBLE CONTAINER

BACKGROUND OF THE INVENTION

The present invention relates generally to a collapsible container for storing and transporting goods.

Portable storage devices that collapse are well known. Four walls each connected by a hinge to a base are selectively movable about the hinge between a use position, in which the wall is generally perpendicular to the base, and a collapsed position. Various mechanisms have been provided to connect adjacent walls at each corner to selectively lock the container in the use position. Many such storage devices unlatch from outside the container, which is sometimes more efficient for a user, but not usable with automated equipment. Other such storage devices unlatch from the inside, which is often desired for use with automated equipment, but less convenient for human users. Further, some containers do not require unlatching at all, but instead are of the knock-down variety which collapsible under suitable force to the wall to sufficient overcome the latch. Moreover, such storage devices may have hinge mechanisms that are difficult or inefficient to manufacture or clean.

Some collapsible containers have walls that may be inwardly folded in order to stack the containers in an efficient and space-conserving manner when not in use. This efficient means of storage is most easily achieved when the container has walls that do not overlap. However, many collapsible containers have relatively tall walls which when assembled, provide a large container volume and depth. Accordingly, when folded, at least one of the pairs of opposed walls will overlap. Unfortunately, the overlapping walls typically result in less efficient stacking of the collapsed containers, because the overlapping second wall will be forced to sit high upon the first wall. Accordingly, the package height and the resulting stacking height of the collapsed unit will be relatively high. Containers that attempt to resolve the overlapping issue have been restricted, often requiring that the walls be folded in a particular sequence, or by having an unsymmetrical design or walls of varied heights. While some of these solutions may be adequate, they may not provide the desired level of strength and rigidity.

Some containers also have a drag rail on their bottom surface that allows a container to be stacked with a like container when assembled, whereby the drag rail of an upper container will sit within the opening defined by the assembled walls of the lower container. While this provides some stability to stacked containers, this design may not be appropriate in every situation. It may also not allow for stable stacking of collapsed containers.

Accordingly, a collapsible container is desired that has versatility in the latch, that is able to accommodate overlapping opposed walls such that they are able to be collapsed and stacked efficiently and comparable or better than those containers not having overlapping opposed walls. It would also be desired for the container to provide the desired level of strength and rigidity. Further it is desired to provide means by which to stack assembled or collapsed containers with some stability.

SUMMARY OF THE INVENTION

It is an object according to the present invention to provide a collapsible container that has a versatile latch suitable for various scenarios by a user.

It is another object according to the present invention to provide a collapsible container having a system of interlocking containers in an assembled stack and a collapsed stack.

It is an object according to the present invention to provide a collapsible container that provides for the walls to be collapsed in an efficient manner and a relatively low package height for purposes of stacking and storing.

It is another object according to the present invention to provide a collapsible container having at least one pair of opposed overlapping side walls which are able to be folded in an efficient manner to provide a relatively low package height.

The present invention provides an improved portable storage device with latch mechanisms selectively connecting adjacent walls at the corners wherein the latches can be actuated from both the inside and from the outside of the crate, and the latch can also be operable in order to define a knock-down style device. Thus, this collapsible container can be used with automated equipment while still being efficient for a human user.

The present invention is also directed to a portable storage device having at least one interlocking member adjacent the latch. The interlocking member is inwardly offset from the outer surface of the wall so that when the walls are collapsed onto the base, the interlocking members will not interfere with the upstanding flange of the base nor will the base modification due to the interlocks be necessary, thus providing for a more rigid and sturdy base.

The collapsible container according to the present invention generally comprises a base wall and generally perpendicular first and second walls. A latch mechanism is integrally molded with the first wall and connects the first wall to the second wall. The latch mechanism includes a recess into which a portion of the second wall is received, thereby latching the first wall to the second wall. The latch mechanism further includes an outer release surface outward of the second wall and an inner release surface inward of the second wall, thus permitting the latch mechanism to be selectively disconnected from the second wall when the walls are assembled upon application of force to the outer release surface or the inner release surface, or to the outer wall surface due to the knock-down characteristics of this type of latch.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENTS

Figure 1:
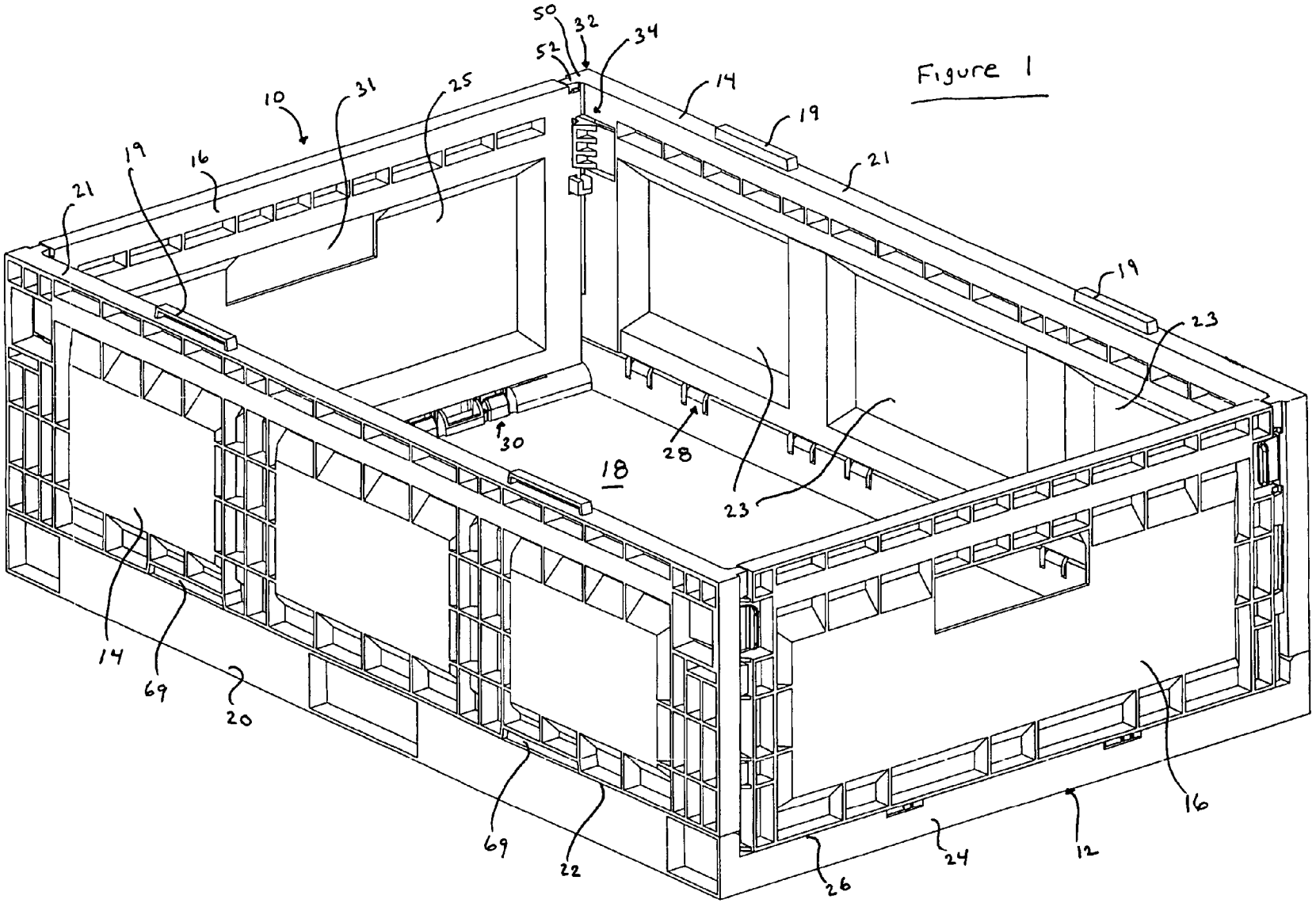
FIG. 1 is a perspective view of the collapsible container according to the present invention.
Figure 2:
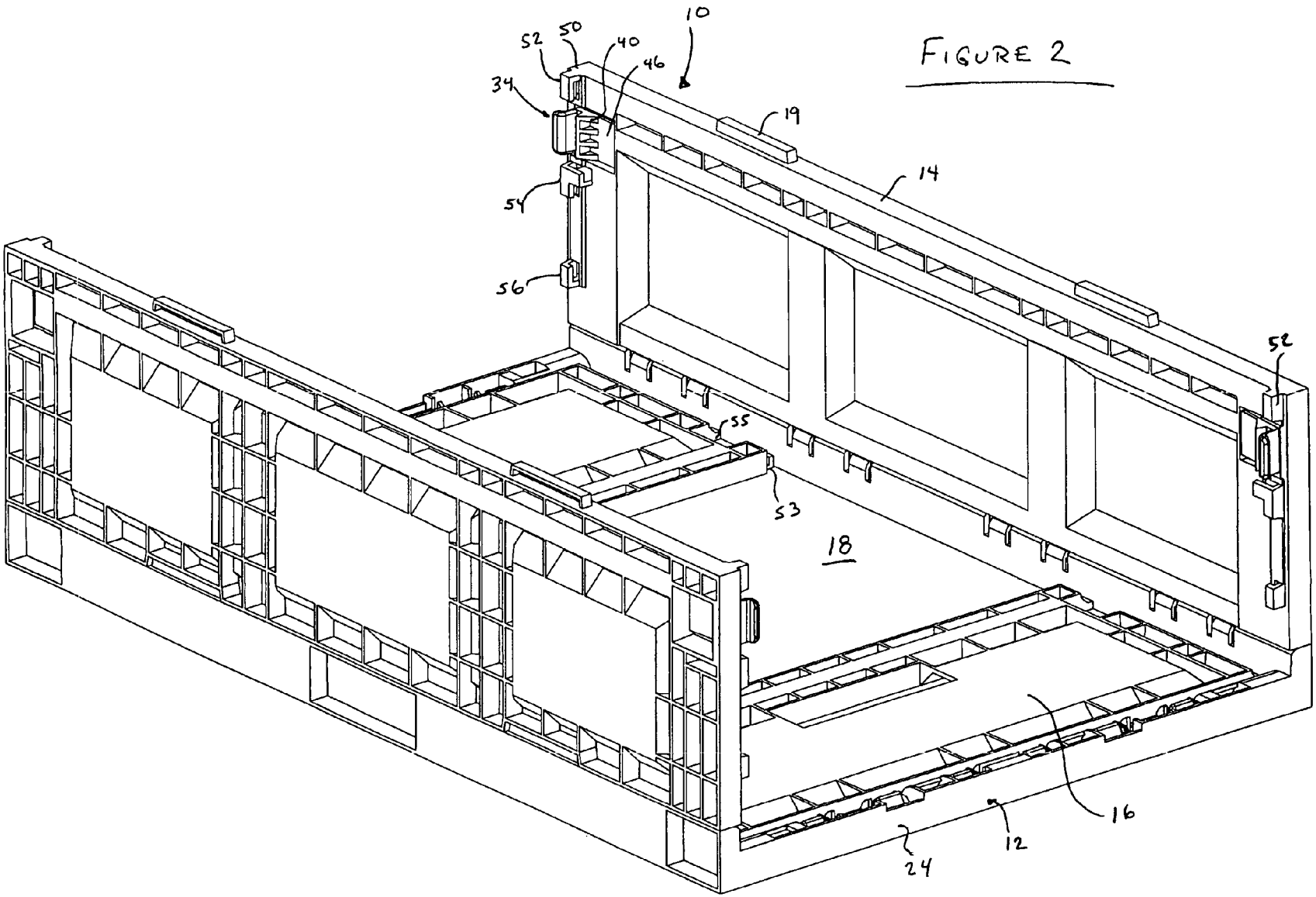
FIG. 2 is a perspective view of the container of FIG. 1, with the end walls in the collapsed orientation.
Figure 11:
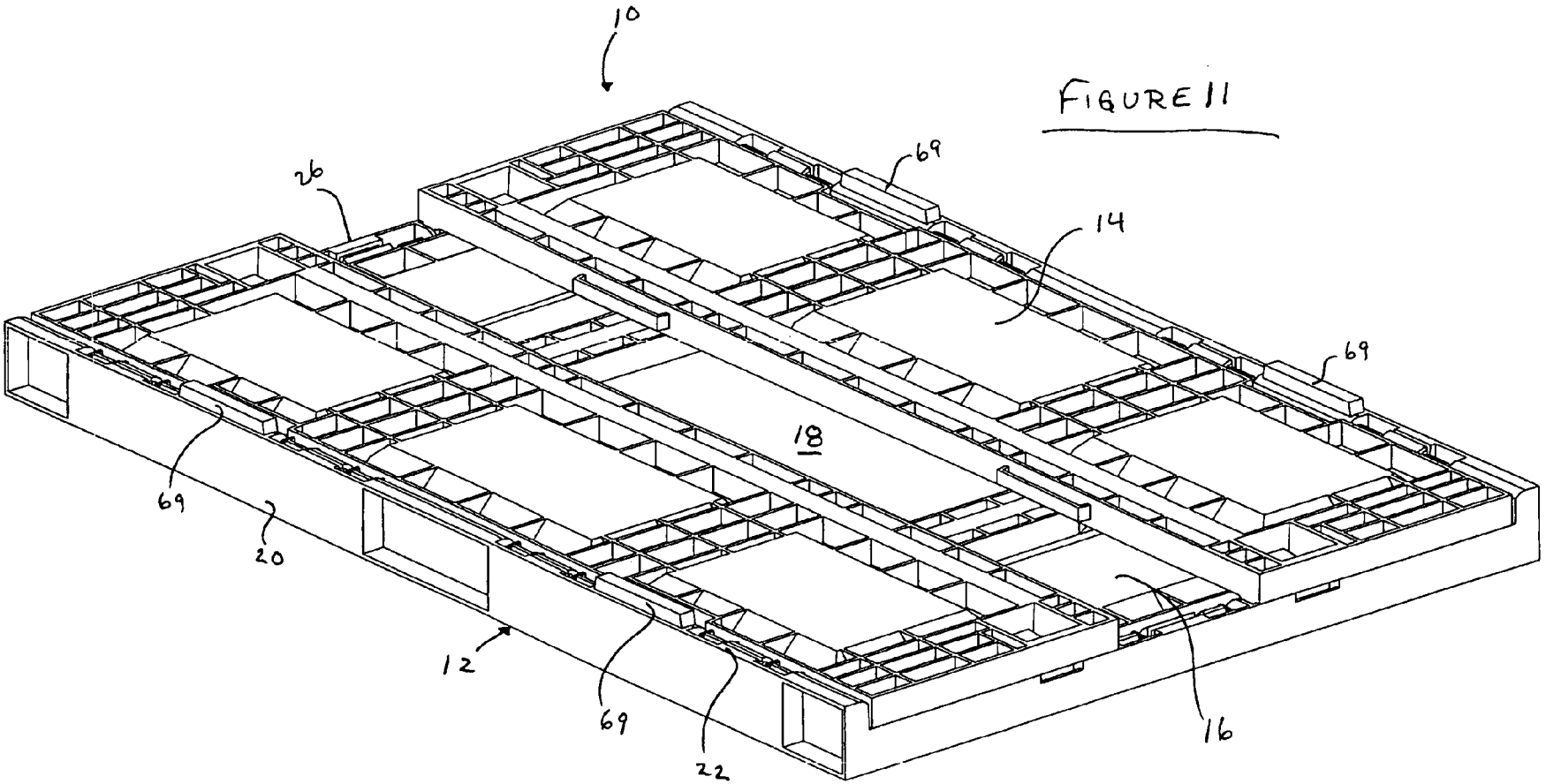
FIG. 11 is a perspective view of the container of FIG. 1 with all the walls in the collapsed orientation.

A collapsible container 10 according to the present invention is illustrated in FIG. 1. Container 10 is rectangular in shape and is generally symmetrical about each center line. Container 10 includes a base 12 and upstanding perpendicular opposing side walls 14 and opposing end walls 16. Base 12 includes a floor 18, a pair of first opposed base side portions 20 defining base side upper edges 22 along the sides of container 10, and a pair of second opposed base end portions 24 defining base end upper edges 26 along the ends of container 10. Side walls 14 are connected to base 12 by hinges 28, while the end walls 16 are connected to base 12 via hinges 30. As is shown, the side walls 14 and end walls 16 are collapsible by pivoting at hinges 28, 30 onto base 12. As shown in FIGS. 2 and 11, the crate can be collapsed inwardly for shipping or storage and can be quickly set up by pivoting walls 14, 16 about their respective hinges to the use position, generally perpendicular to floor 18. Side walls 14 include tabs 19 extending above the upper edge 21 of side walls 14 for providing an inter-engaging feature between stacked containers 10, as discussed further herein. Side walls 14 each include three areas 23 which are bowed outwardly, while end walls 16 each include one such relatively larger area 25. End walls 16 include a handle opening 31. In the present embodiments, the end walls 16 are first to collapse against floor 18 and by way of reference but not limitation may generally be referred to as end walls or second walls. Of course, the teachings of the latched herein may be application to either set of walls. Side walls 14 may be referred to as first walls.

Figure 3A:
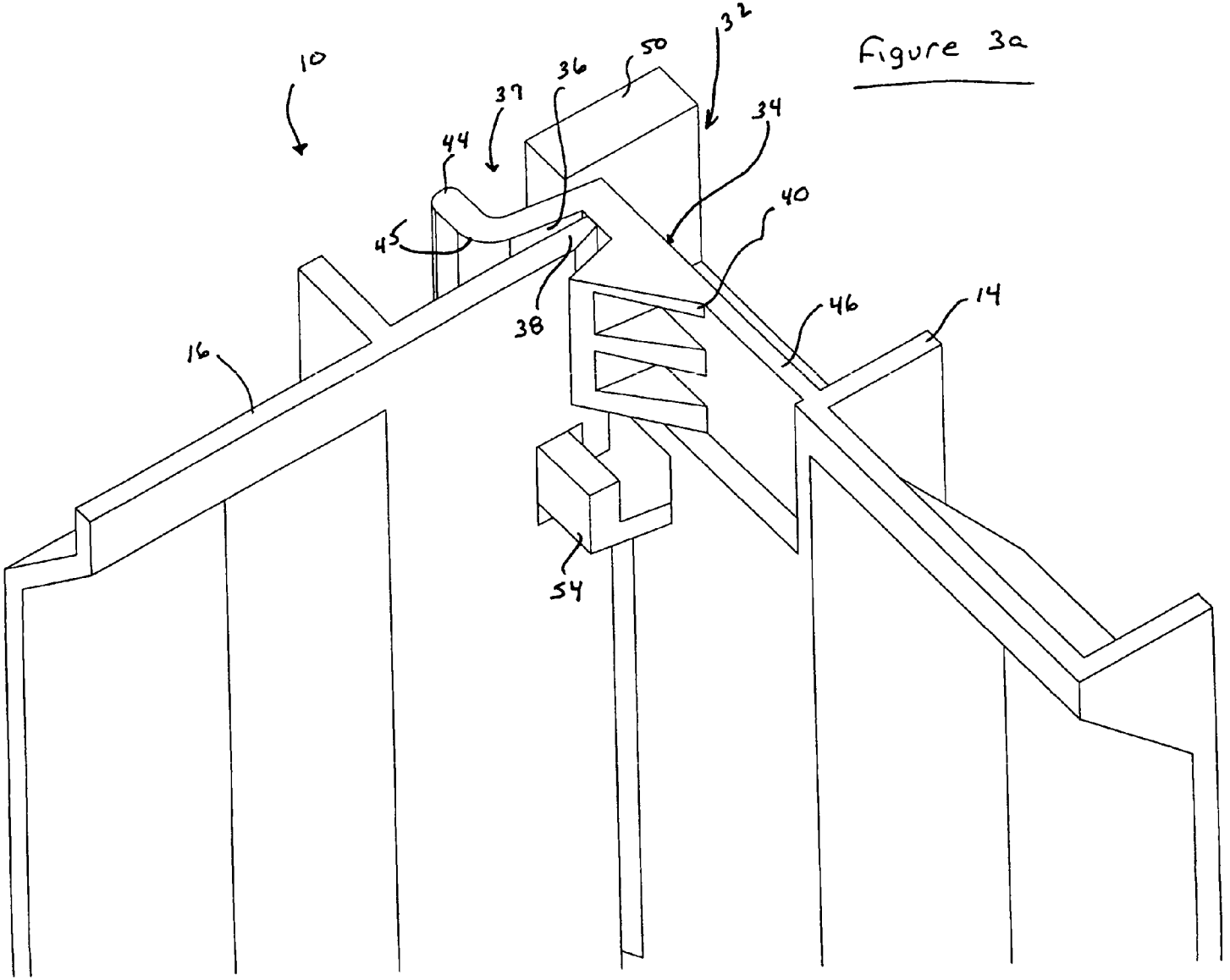
FIG. 3*a* is an enlarged perspective interior view of one corner of the collapsible container of FIG. 1, with the top of the container cut away.
Figure 3B:
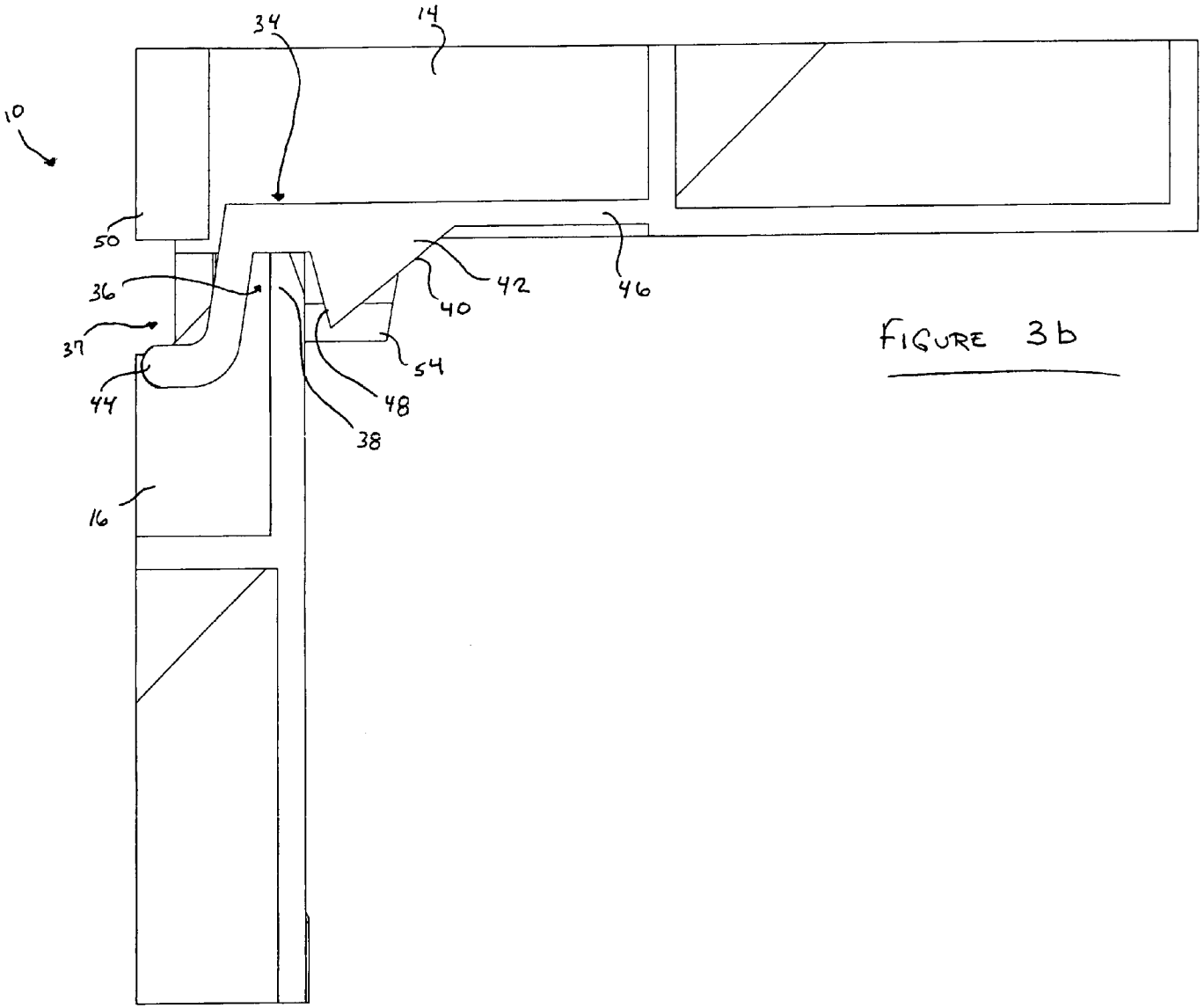
FIG. 3*b* is a top plan view of the portion of the collapsible container of FIG. 3*a;*

Container 10 also includes latches 34 for attaching adjacent side and end walls at the corners 32. Because the operation of each of latch 34 is similar, the operation of latch 34 will be described with reference to FIGS. 3*a*, 3*b*, 4*a*, 4*b*, 5*a*, and 5*b*. FIG. 2 illustrates container 10 with end walls 16 in the collapsed position for better illustration of latch 34. FIG. 3*a* is an enlarged perspective view of the interior of corner 32, with the top of the container 10 cut away. Latch 34 is integrally molded with side walls 14, which is preferably molded of polypropylene via an injection molding process but of course can be formed of any type of plastic applicable for the desired use. As can be seen in FIGS. 3*a* and 3*b*, latch 34 includes a recess 36 within which a narrow, outboard portion 38 of the lateral edge of end wall 16 is received to attach end wall 16 to latch 34 and thus side wall 14. The narrow portion 38 of side wall 14 helps define a recess 36 on the outside of end wall 16. Latch 34 includes an inner release surface 40 extending into the container that is generally an inclined plane on a portion 42 tapering inwardly into container 10. In the assembled position, inner release surface 40 is positioned inwardly of recess 36 and end wall 16. Surface 40 may be used to actuate the latch 34 and collapse the container, whether by user or automation.

Latch 34 further includes an outer release surface 44, which is the outer portion of latch arm 45. Surface 44 is positioned outwardly of recess 36 and outwardly of narrow portion 38 of side wall 14. The outer release surface 44 is generally positioned within recess 37 of the end wall 16, such that the outer release surface 44 can be accessed through the recess 37. An inner end of the latch 34 includes a slightly narrowed portion 46, which increases the flexibility of latch 34 and permits it to pivot and flex at narrowed portion 46. FIGS. 4*a*, 4*b*, 5*a*, and 5*b* illustrate the latch at various positions from fully latched to unlatched. In FIGS. 3*a*-3*b*, the end wall 16 is latched to side wall 14 by latch 34. The portion 38 of end wall 16 is securely received in the recess 36 of latch 34. In this manner, the side wall 14 and end wall 16 are maintained in a generally perpendicular assembled position. In the embodiment shown, the outer release surface 44 is completely contained and enveloped within the recess 37 and does not protrude out from the plane of end wall 16. Thus a user may collapse the container by actuating release surface 44.

Figure 4A:
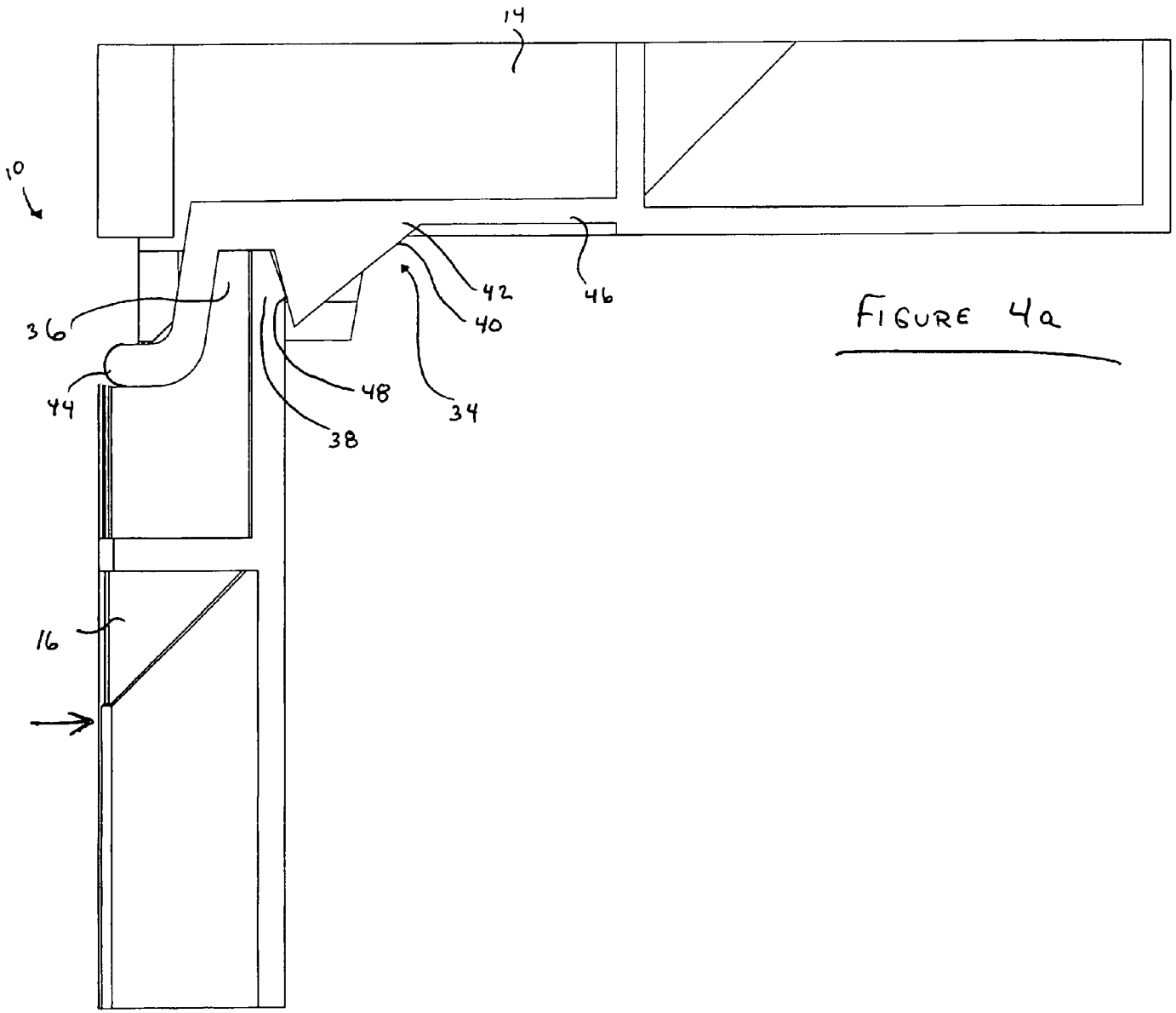
FIG. 4*a* is top plan view of the portion of the area shown of FIG. 3*a* with the latch in the moving into unlatched position.
Figure 4B:
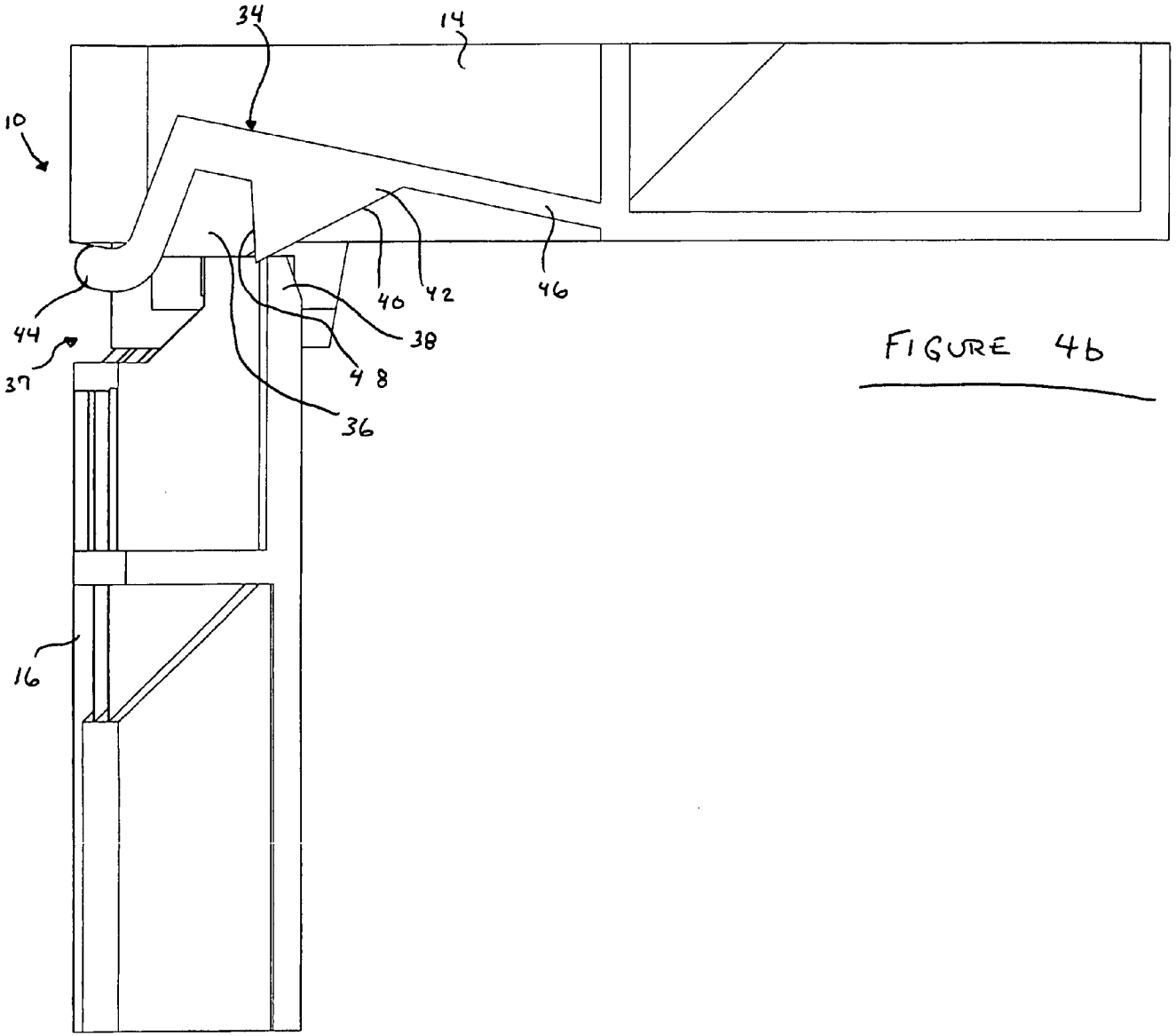
FIG. 4*b* is another top plan view of the area shown in FIG. 4*a*, of the latch moving further into the unlatched position.
Figure 5A:
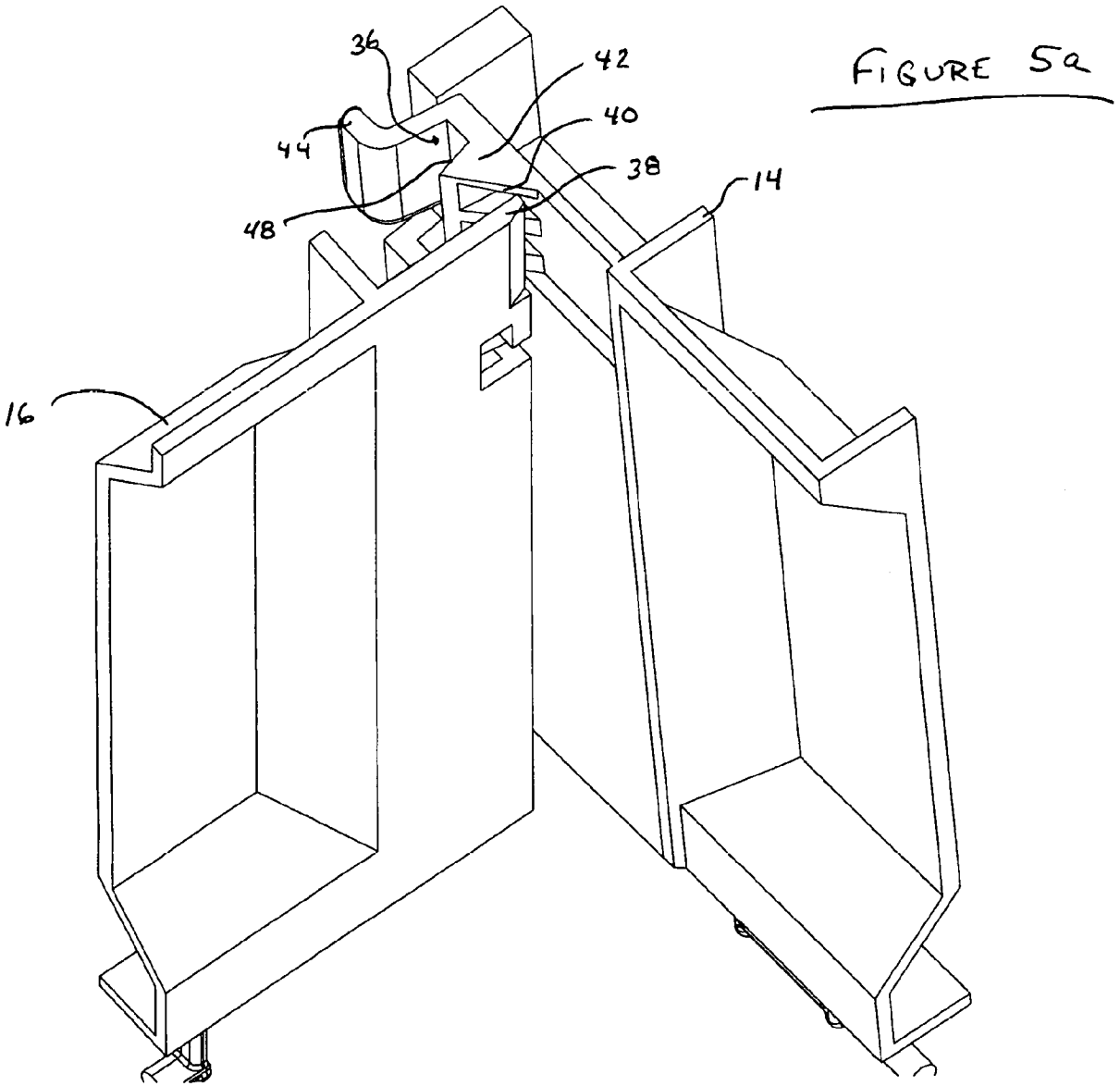
FIG. 5*a* is an enlarged perspective interior view of the corner area of FIG. 3*a*, with the end wall in the collapsed position and the latch in the unlatched position.
Figure 5B:
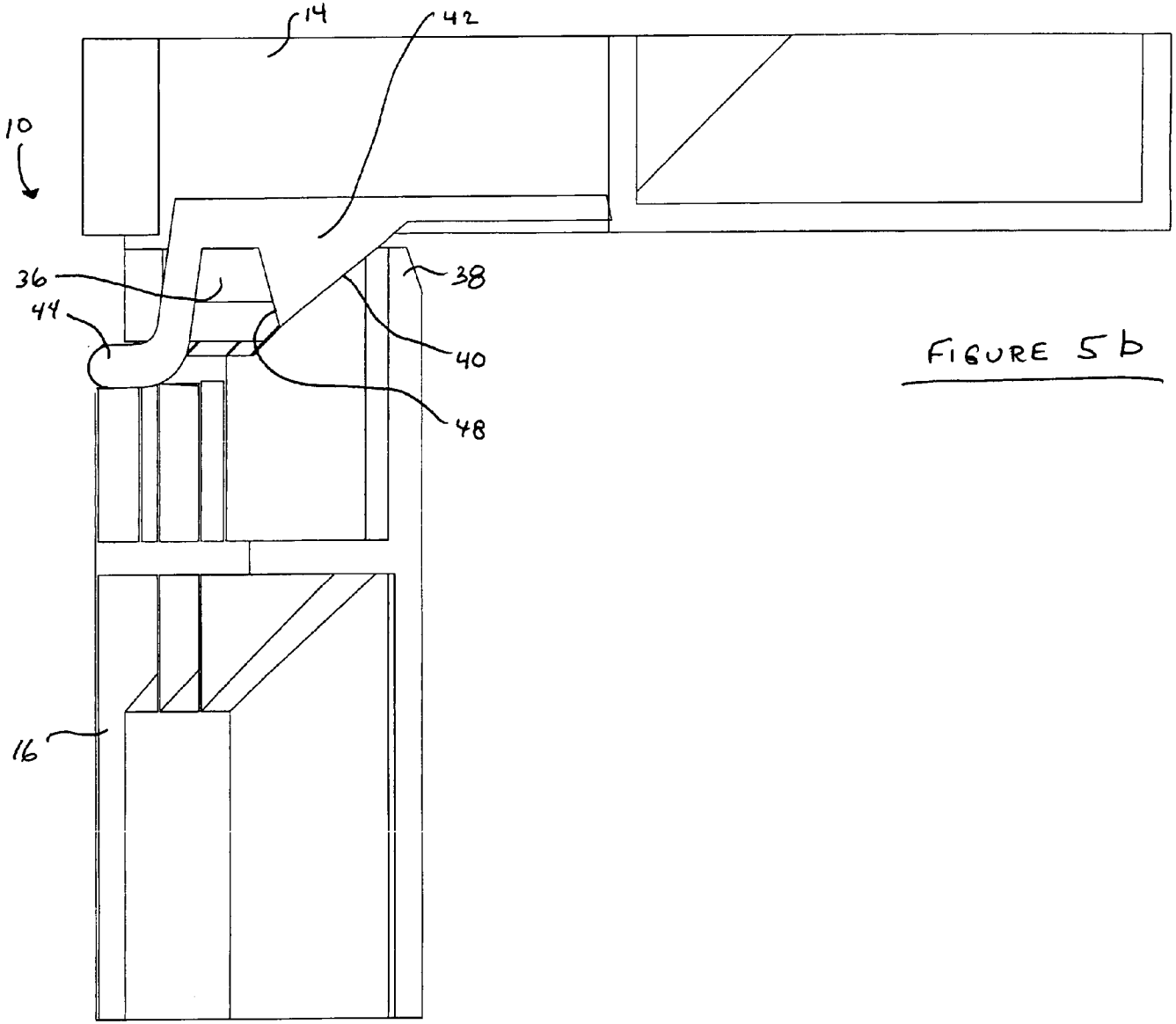
FIG. 5*b* is a top plan view of FIG. 5*a;*

Opposite inner release surface 40 and adjacent wall portion 38, is a surface 48 of latch 34 that is shown as slightly angled in order to promote an additional feature of latch 34 as a knock-down style latch. Thus, should a user desire to use the knock-down features of container 10, the user may provide a slight force to the outer surface (in the direction of the arrow of FIG. 4*a*), thereby causing wall 16, and more particularly wall portion 38, to contact outer latch surface 48, and thereby causing wall 16 to slide along angled surface 48, allowing latch 34 to deflect out of the way in order for wall 16 to bypass the latch and collapse onto base 12. These steps are shown in FIG. 4*a* (end wall 16 contacts surface 48), FIG. 4*b* (wall 16 deflects latch as it moves into collapsed position) and FIGS. 5*a*-5*b* (wall 16 clears latch 34 and approaches collapsed position.) The force necessary to operate the knock-down feature may vary based on the desired latch resistance. Note that while surface 48 be disposed at various angles, surface 48 is only slightly angled sufficient to allow it to be knocked down with the desired force.

As shown in FIGS. 1, 2 and 3*a*, side walls 14 include an integrally molded section 50 positioned outwardly of latch 34 for preventing excessive outward deflection of the latch 34. Side walls 14 and end walls 16 also include at least one set of interlocking tab members 52, 53 (see FIG. 2), respectively, to increase the stability of the connection between side walls 14 and end walls 16 at corner 32 as well as enhance alignment therebetween. Three sets of interlocking members are illustrated herein: interlocking tab members 52, 54, 56 on side wall 14 interlock with corresponding interlocking tab members 53, 55, 57 on end wall 16. Note that such interlock members are inwardly offset from the outer surface of the adjacent walls 14, 16 as disclosed further herein.

When it is desired to return container 10 to the collapsed position, latch 34 is biased and flexed outwardly in the direction of post 50 by the application of force on either the outer release surface 44, the inner release surface 40, or the inwardly directed force on the end wall 16 via the knock-down feature. This causes latch 14 to flex and pivot at the narrowed portion 46 and releases the portion 38 of end wall 16 from the recess 36 of the latch. The provision of the outer release surface 44 permits the actuation of the latch 34 from outside container 10, which is easier for a user. The inner release surface 40 facilitates operation by automated equipment. The knock-down feature promoted by surface 48 allows for a quick means to collapse without manual contact with latch 34 itself. End wall 16 is then able to pivot downward to the collapsed position (after similarly actuating the latch at the opposite end of end wall 16). The opposing end wall is unlatched in a similar fashion and pivoted to the collapsed position, followed by the side walls 14.

For assembly of container 10 to the use position, side walls 14 are pivoted upward to the use position, generally perpendicular to the floor 18. End wall 16 is then pivoted upward, causing narrowed portion 38 of end wall 16 to contact the inner release surface 40, causing latch 34 to flex outwardly as in FIG. 4*b*. When the narrowed portion 38 of end wall 16 passes the inner latch release surface 40 and outer latch surface 48, latch 34 returns to its normal position with the narrowed portion 38 received in recess 36 of the latch 34, thus returning the container to the assembled position of FIG. 1.

Figure 6A:
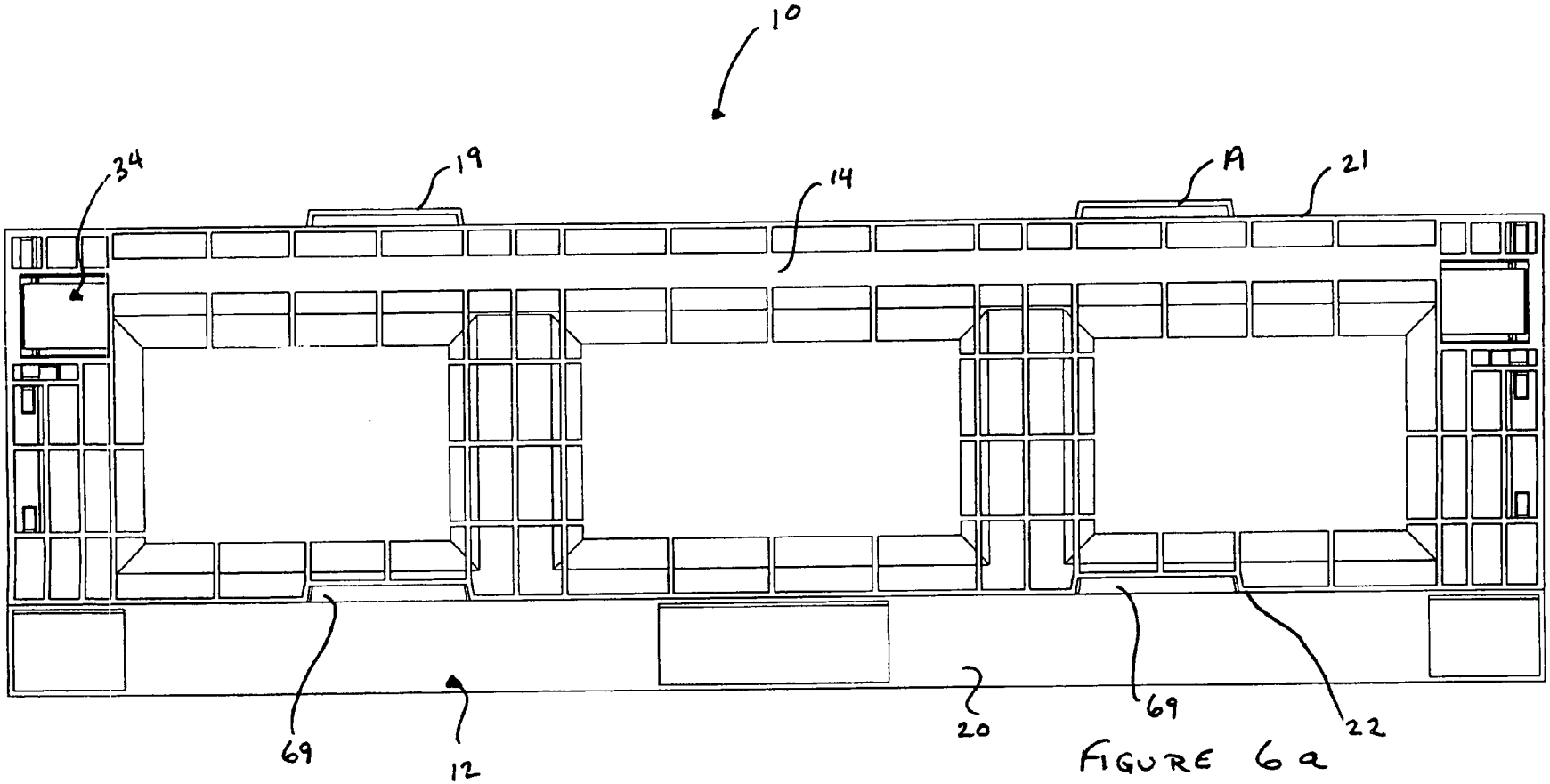
FIG. 6*a* is a side elevational view of the container of FIG. 1.
Figure 6B:
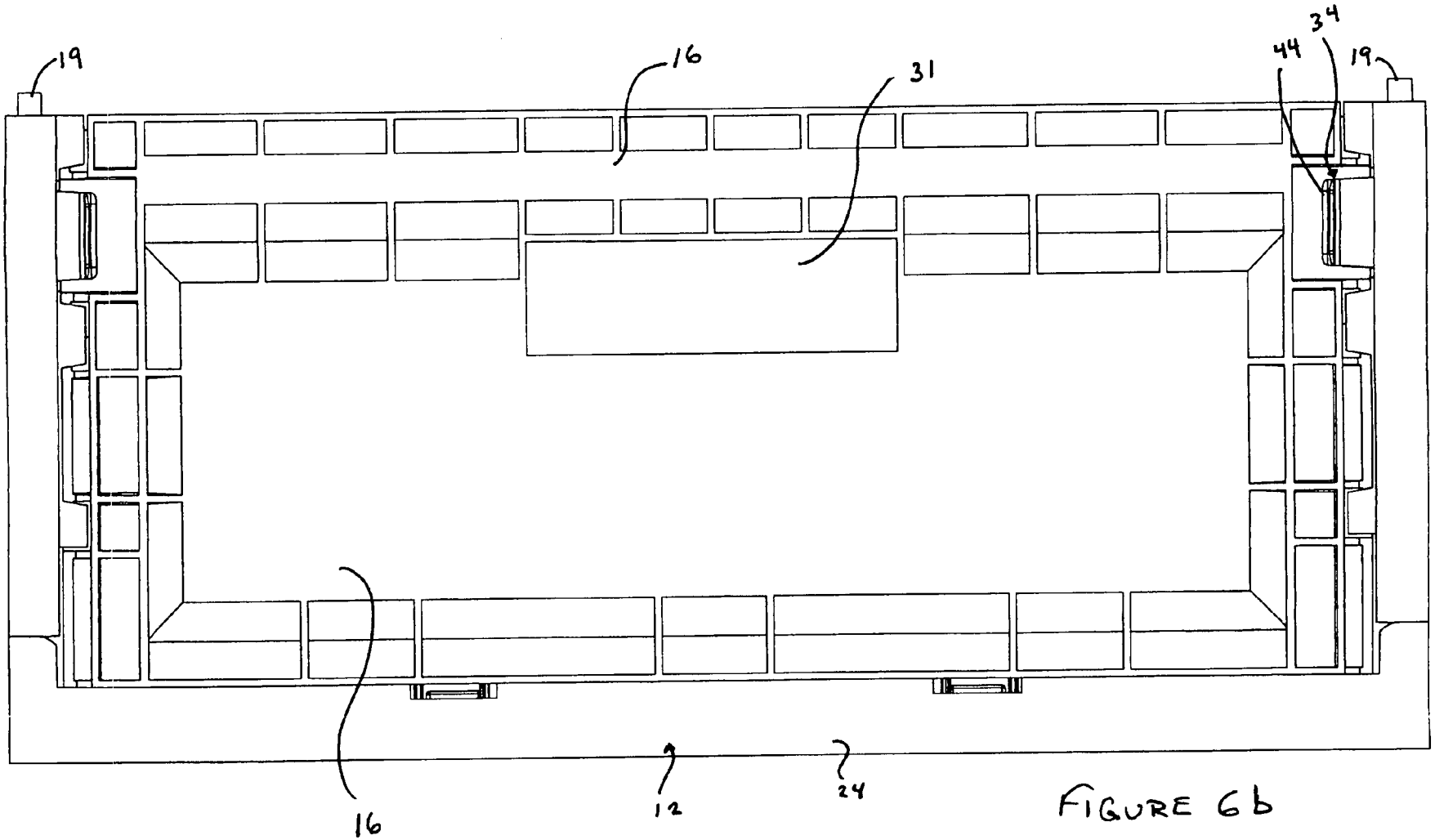
FIG. 6*b* is an end elevational view of the container of FIG. 1.

FIG. 6*a* illustrates a side view of container 10, while FIG. 6*b* illustrates an end view of container 10.

Figure 7:
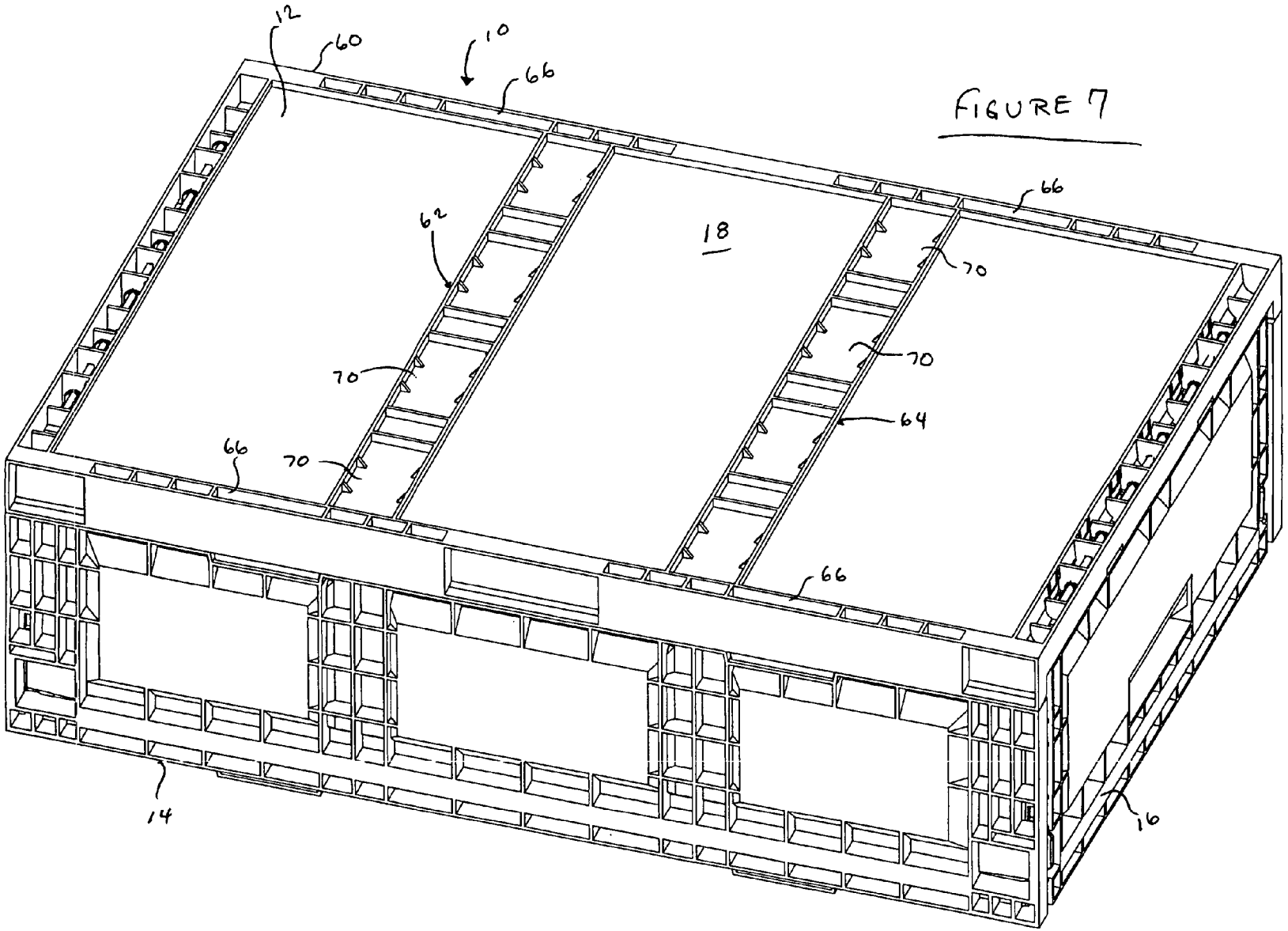
FIG. 7 is a bottom perspective interior of the container of FIG. 1
Figure 8:
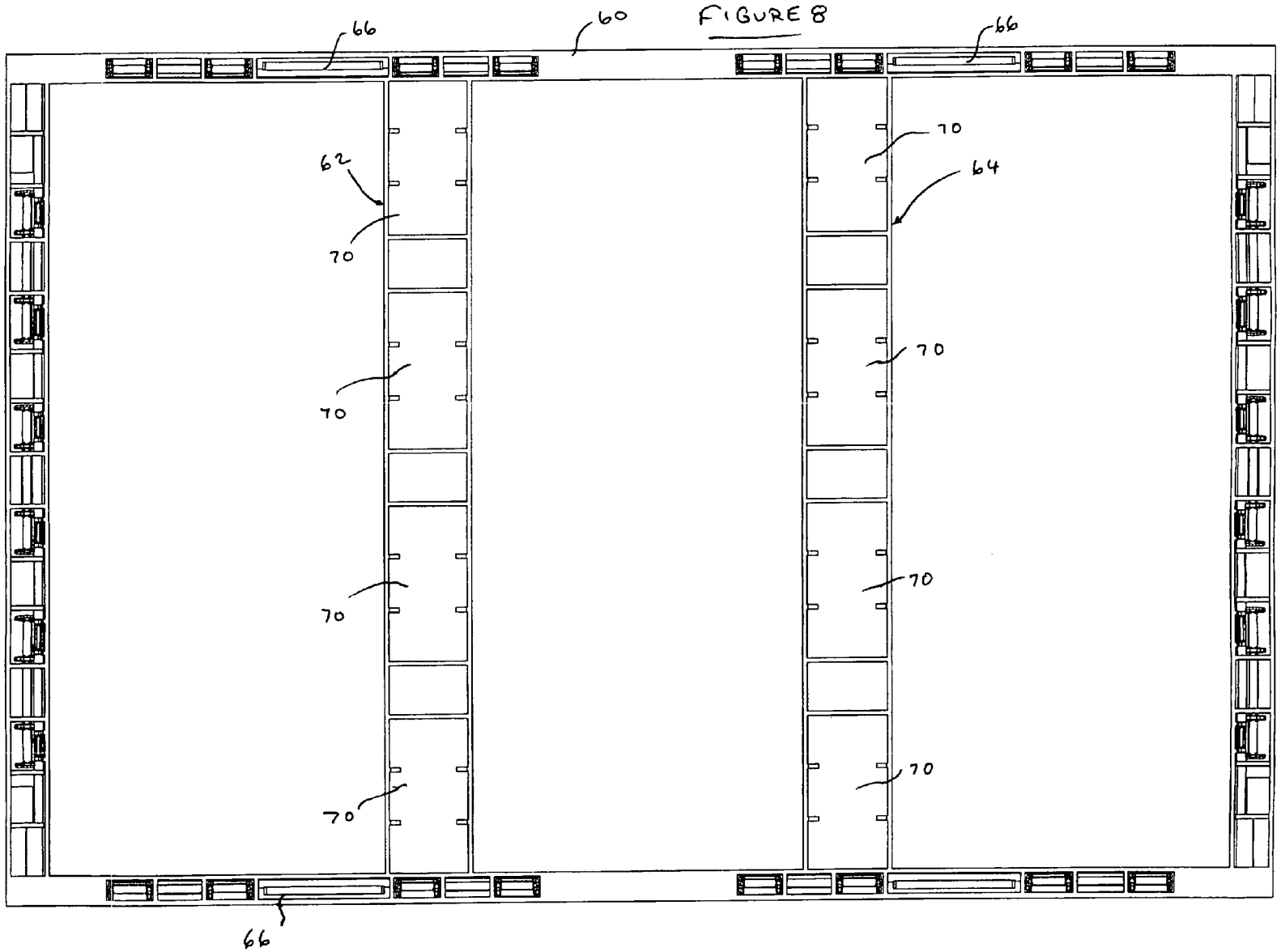
FIG. 8 is a bottom plan view of the container of FIG. 1.
Figure 9:
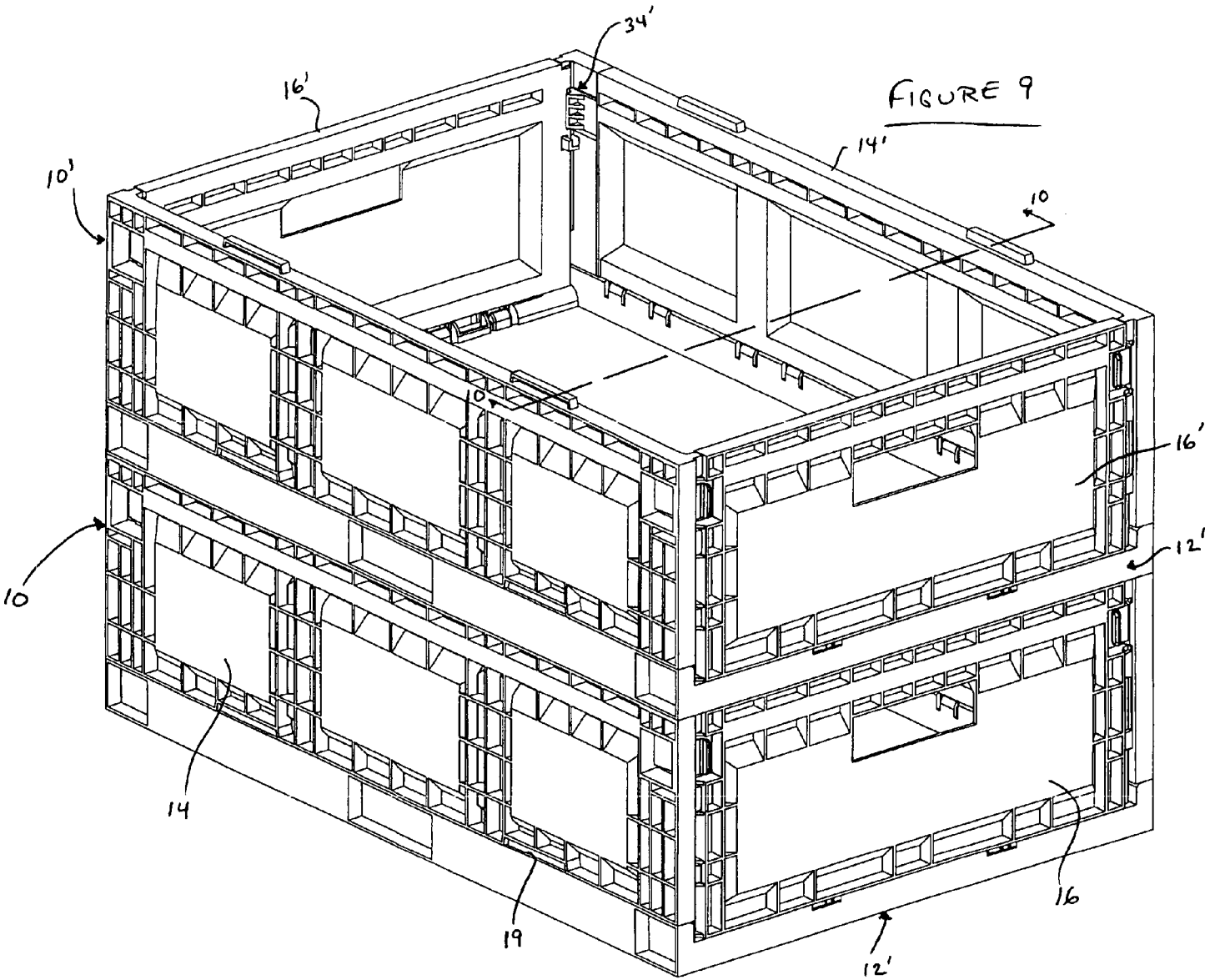
FIG. 9 shows two similar containers according to FIG. 1 in an assembled and stacked orientation.
Figure 10:
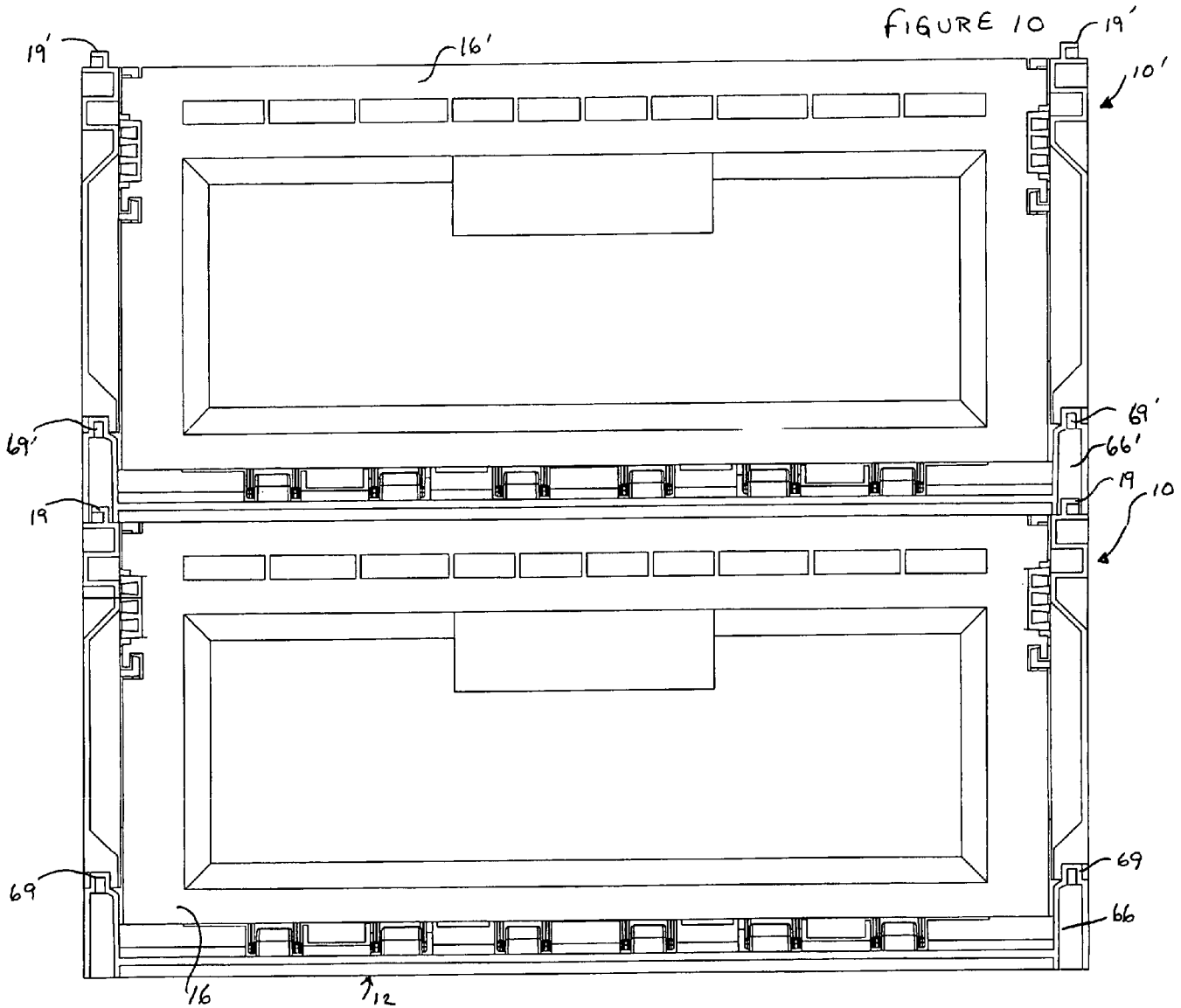
FIG. 10 is a cross-sectional view of the container along the line 10-10 of FIG. 9.

FIG. 7 illustrates a bottom perspective view of container 10 and FIG. 8 shows a bottom plan view thereof. As illustrated, this container does not include an drag rail offset from the periphery as is known in other containers, but instead has a generally parallel set of ribs 60 extending around the periphery of container 10 extending from the lower surface of floor 18, and also includes two sets of parallel ribs 62, 64 extending widthwise across the lower floor surface. The peripheral set of ribs 60 defines therein a series of openings 66 for receiving side wall upper edge tabs 19 when two similar assembled containers 10, 10' are stacked together (as in FIGS. 9-10), thereby allowing for an inter-engaging feature therebetween. A perspective view of two assembled containers 10, 10' is shown in FIG. 9, while a cross sectional view showing the inter-engagement between tabs 19 and openings 66' of an upper container 10' is shown in FIG. 10.

Figure 12:
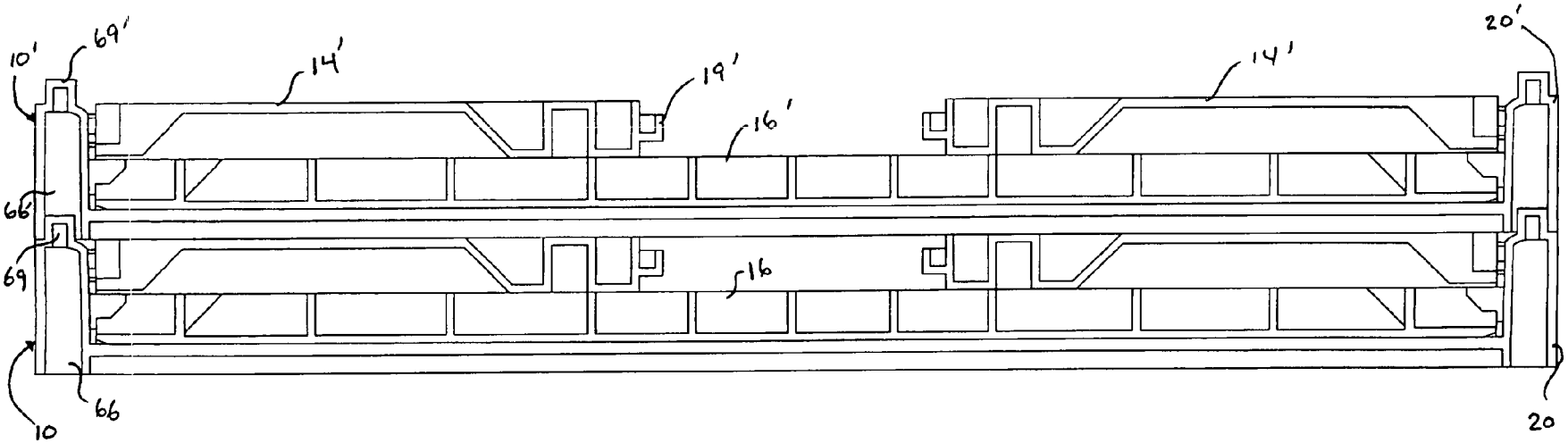
FIG. 12 is a cross-sectional view of two containers as in FIG. 11 stacked together.
Figure 13:
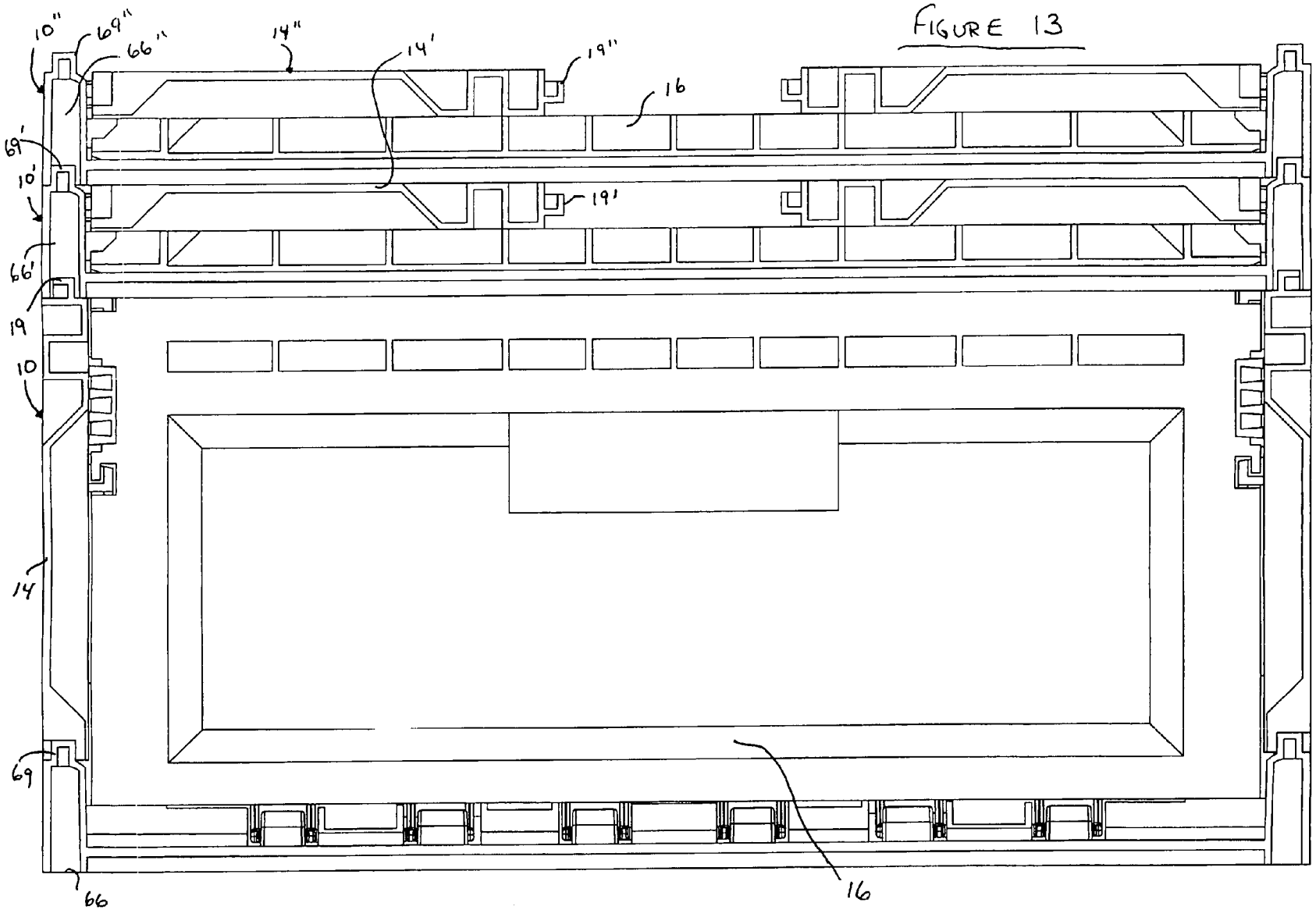
FIG. 13 is a cross sectional view of three containers in a stacked orientation, the bottom container assembled as in FIG. 1, and the upper containers collapsed as in FIG. 11.
Figure 14A:
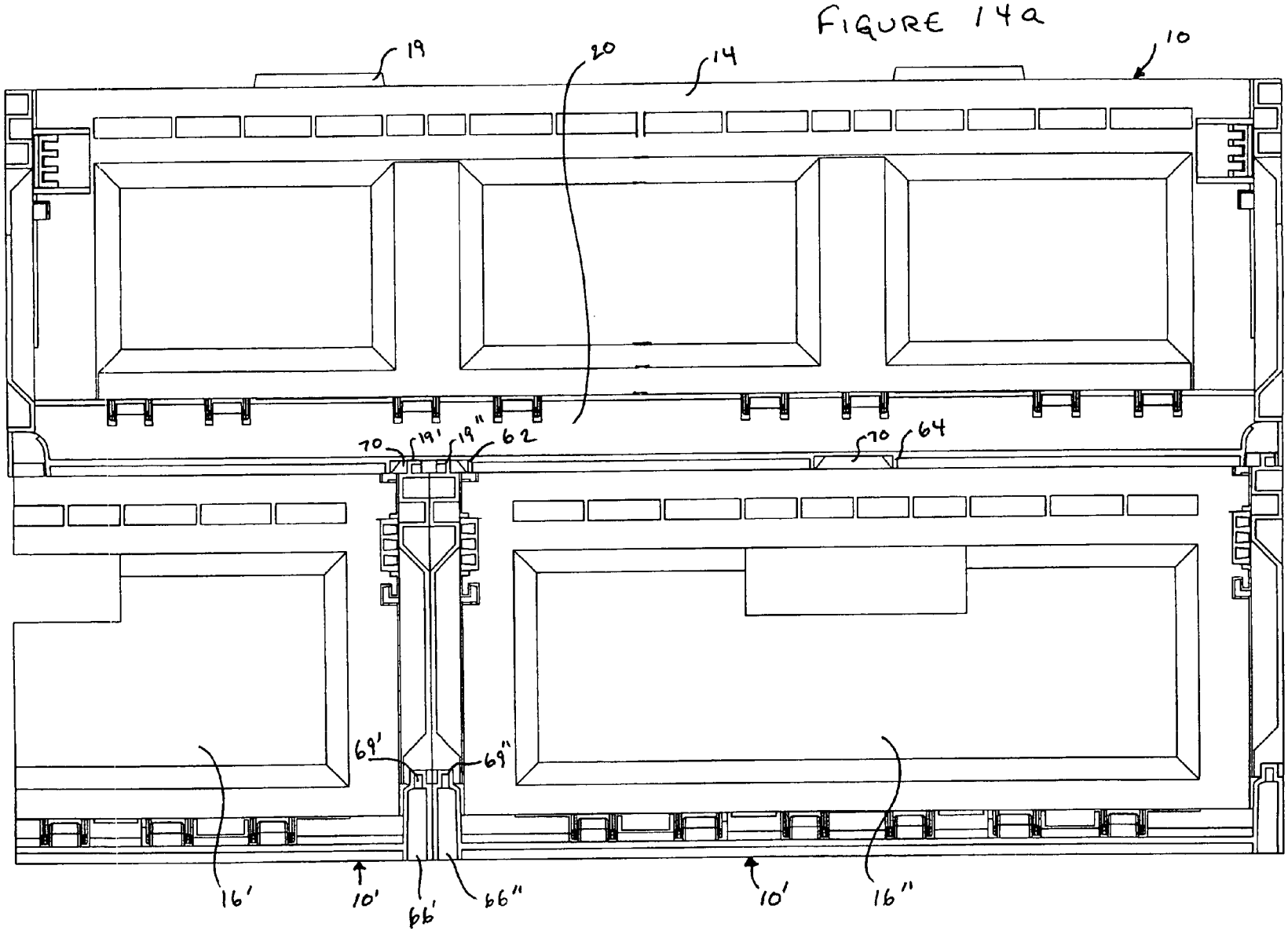
FIG. 14*a* is a cross-sectional view showing three assembled containers in a cross-stacked orientation.
Figure 14B:
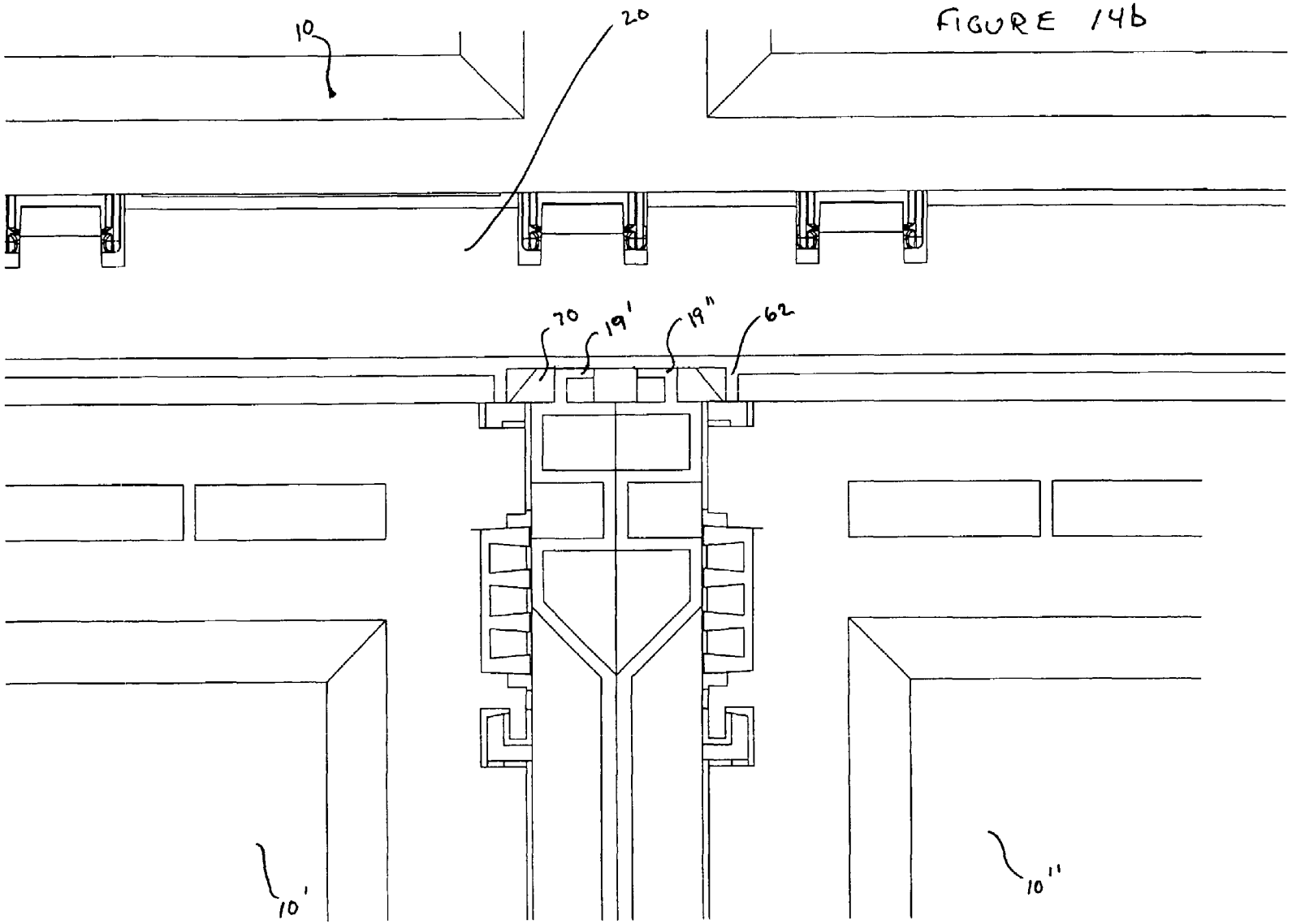
FIG. 14*b* is an enlarged view of a portion of FIG. 14*a;*

Moreover, as shown in FIG. 11, when the walls 14, 16 are collapsed, it is noted that the upper edges 22 of the side base walls 20 have tabs 69 similar tabs 19. Tabs 69 are preferably similarly sized and in vertical alignment with wall tabs 19, such that when the walls are collapsed and similar collapsed containers 10, 10' are stacked together as shown in FIG. 12, tabs 69 are received in corresponding openings 66' of base 12', thereby aiding in interengagement between the two. As shown in FIG. 13, tabs 19 and 69 can also work together to promote interengagement between a stack having both assembled 10 and collapsed containers 10', 10". With reference to FIGS. 14*a*-14*b*, note that tabs 19, 69 are also designed to align with openings 70 between respective rib sets 60, 62, 64 for allowing similar collapsed containers to interengage during cross-stacking. See FIG. 14 which illustrates a bottom of container 10 with the tabs 19' and 19" of lower containers 10 and 10' disposed in openings 70.

Figure 15:
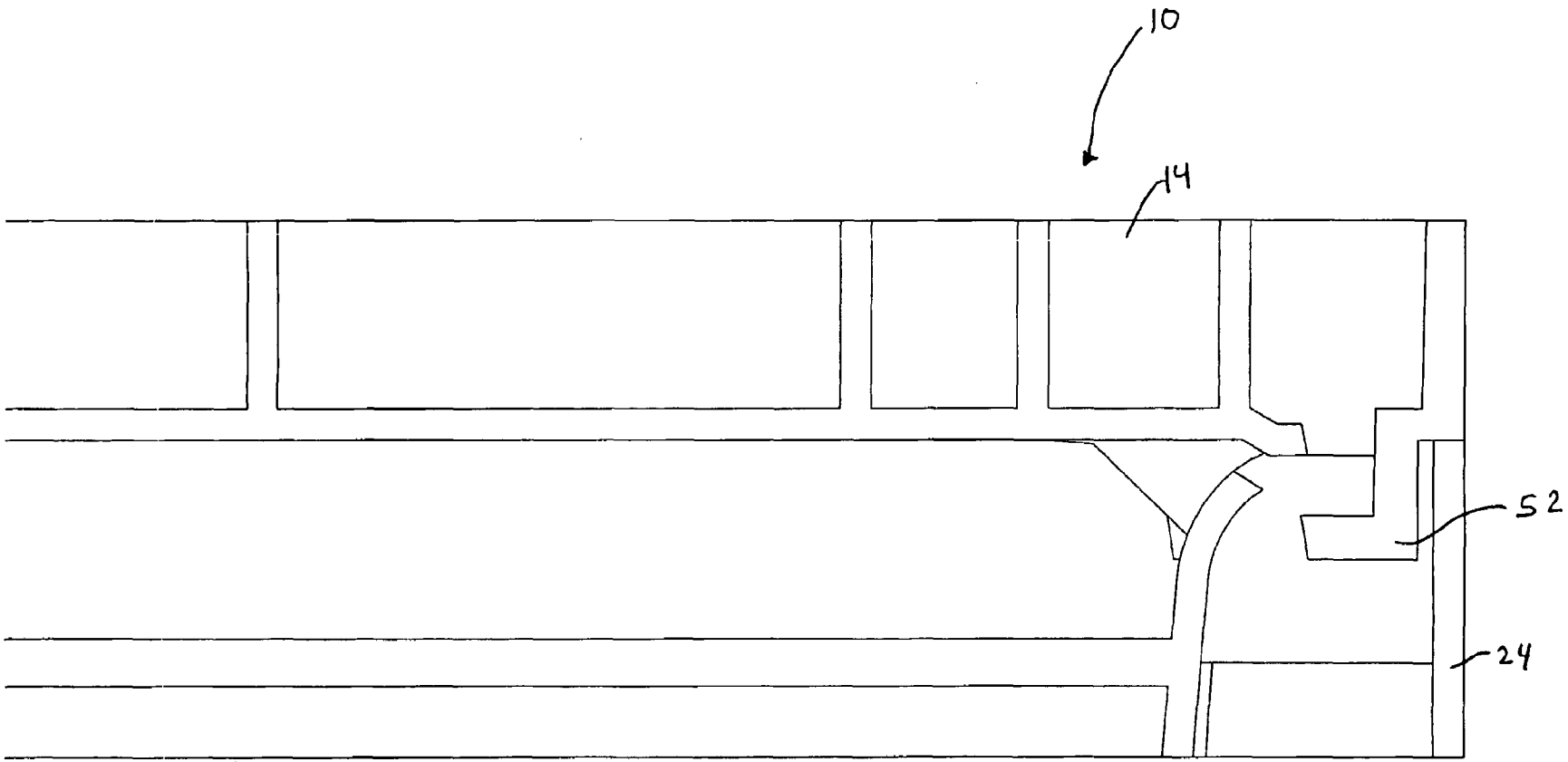
FIG. 15 is a cross-sectional view of the collapsed container showing one of the plurality of interengaging features.

FIG. 15 illustrates the offset feature of interlocking tab 52, 54, and 56 on side wall 14. For illustrative purposes only, tab 52 is used. As shown, tab 52 is offset from the edge of side wall 14. Thus when folded downwardly, the offset tab 52 does not interfere with base wall 24, but instead clears base wall 24 and sits inwardly thereof. In some containers, the tab may be flush with the surface of the wall, such that cutouts or recesses must be formed in the base to accommodate the interlock features. Such cutouts and recesses may tend to not be as rigid as possible.

Figure 16:
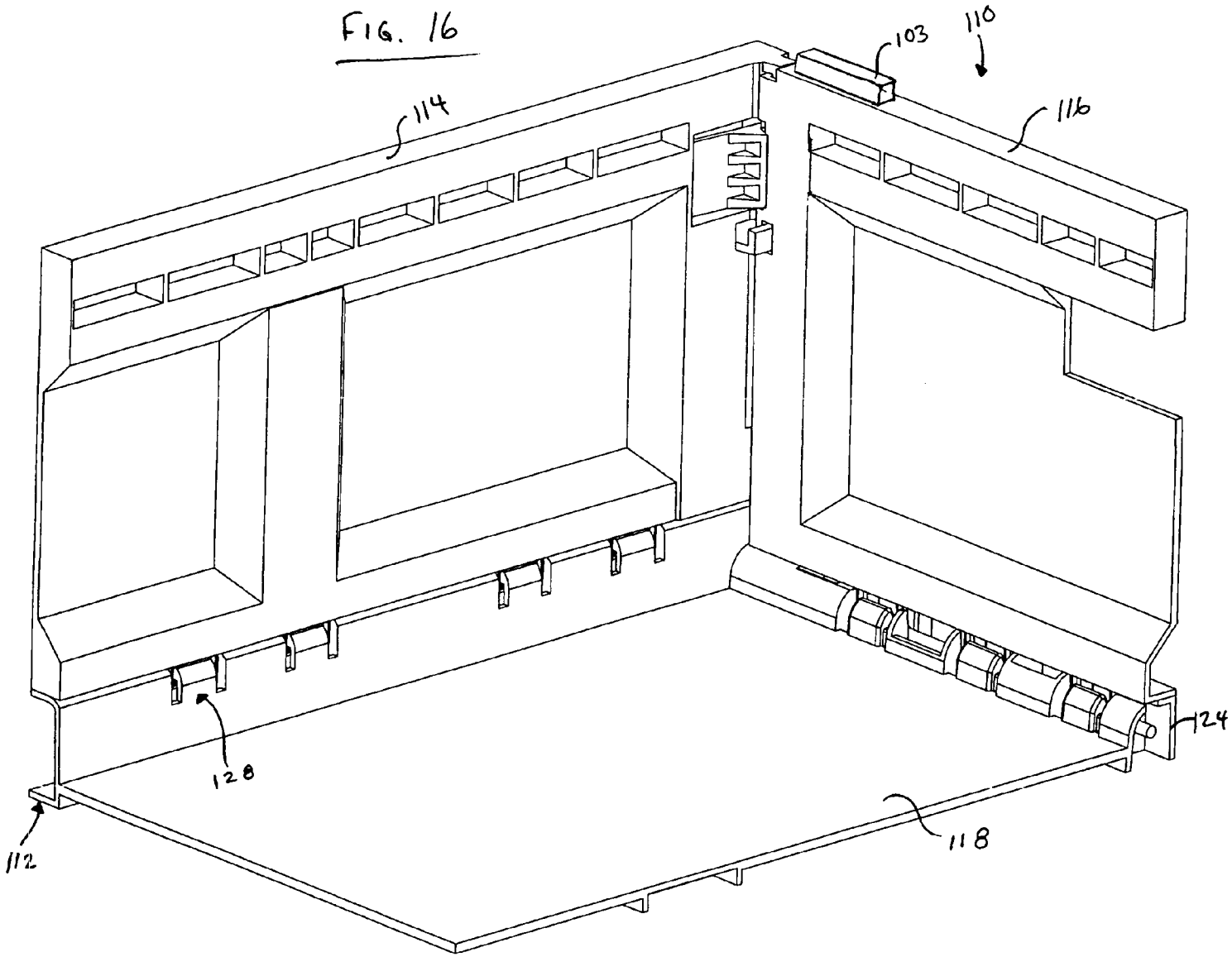
FIG. 16 shows a container similar to that of FIG. 1, but having a tab on the end wall.

FIG. 16 is a partial inner perspective view of a container similar to FIG. 1, but having a tab 103 (similar to tab 19 of FIG. 1) on the end wall 116. Such tab 103 may serve to provide additional interengagement when similar containers are stacked together.

Figure 17:
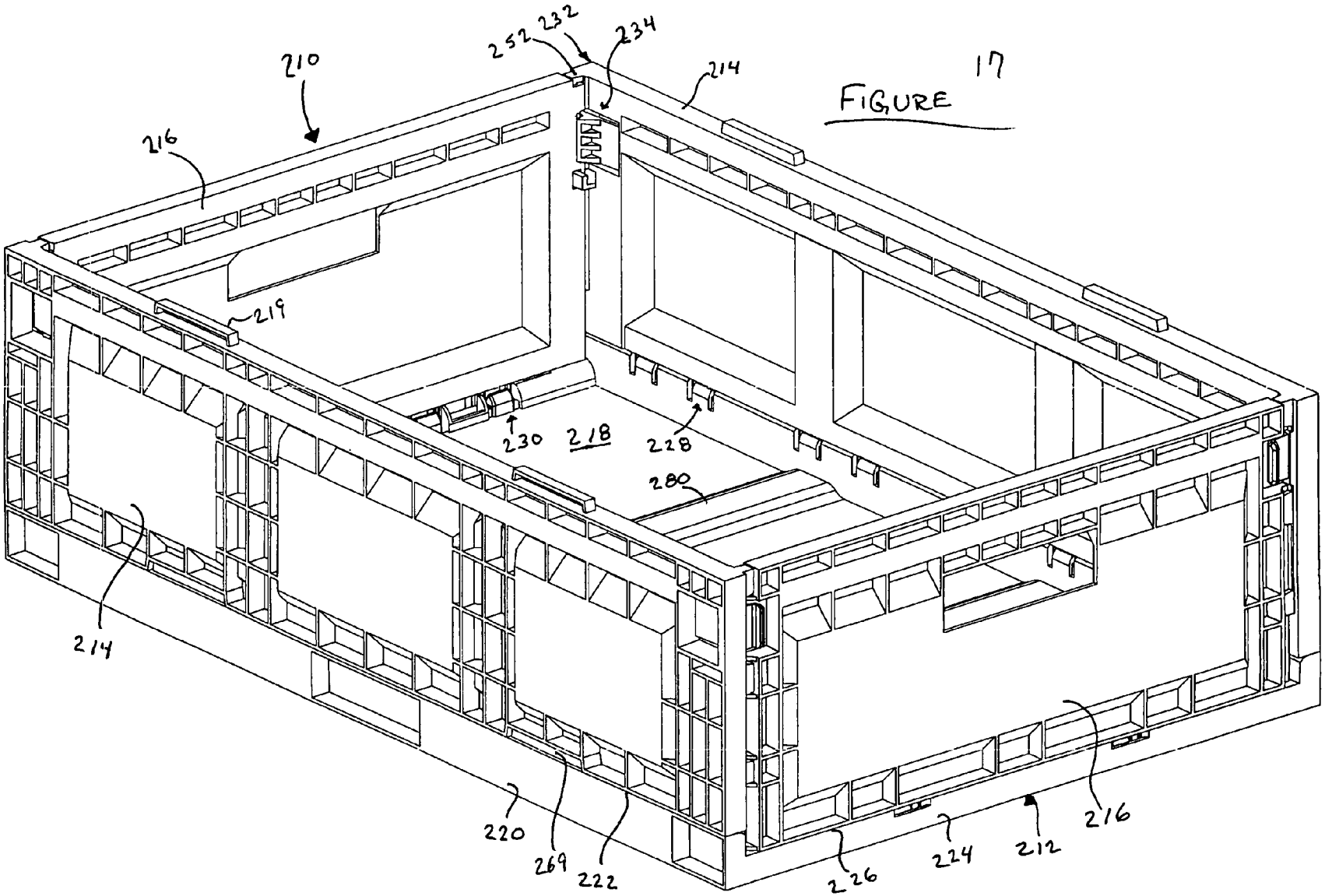
FIG. 17 shows a container similar to that of FIG. 1, but having a base with undulations.
Figure 18:
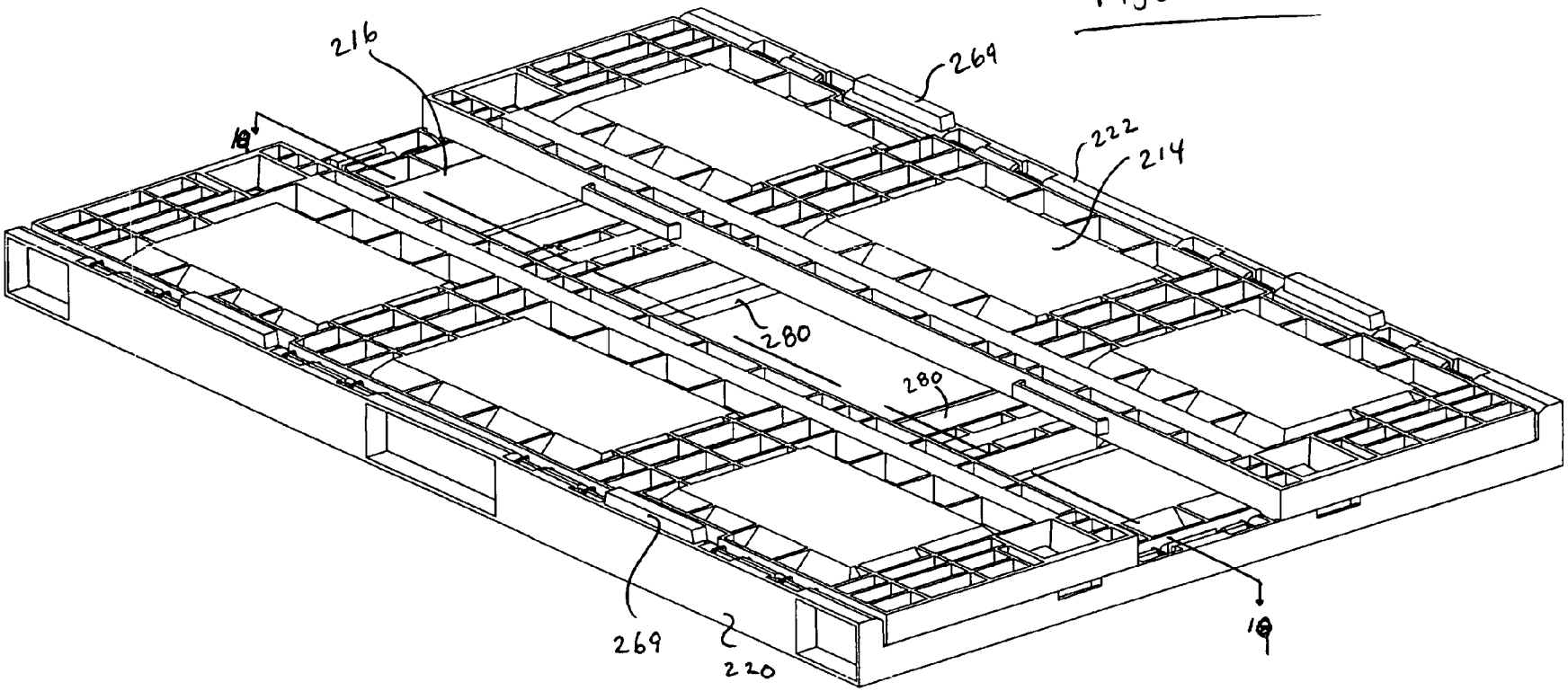
FIG. 18 shows the container of FIG. 17 fully collapsed.
Figure 19:
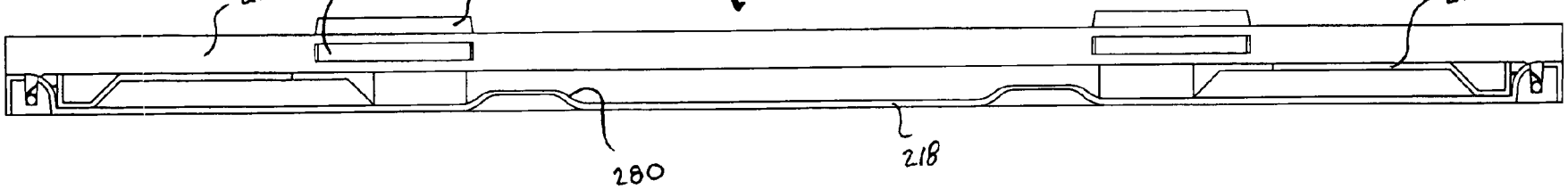
FIG. 19 is a cross-sectional view taken along line 19-19 of FIG. 18.

FIG. 17 is a perspective view of a container similar to FIG. 1, but having a base with a lower floor and pair of undulations 280 formed in the floor for a more efficient package height when collapsed. FIG. 18 shows the container in the fully collapsed position. As shown in FIG. 19, undulations 280 are actually at a height similar to floor 18 in FIG. 1, while floor 218 is on a plane similar to rib sets 60, 62, 64 of FIGS. 7-8. Thus as shown in FIG. 19, floor 218 defines a corresponding recessed area on the top surface of floor 218 on the inside of container 210 adjacent undulations 280, so that when walls 216 are collapsed, they are folded into the recessed areas in order to create a more efficient package height. Moreover, the undersides of undulations define a recess 270 for receiving tabs 219, 269 during cross-stacking similar to that shown in FIGS. 14*a*-14*b*.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. There are many different configurations for collapsible containers and many variations in design, many of which would benefit from the present invention. All are considered to be within the scope of the present invention. For example, latches 34 could be on end walls 16 instead of side walls 14. Modifications to latch 34 for different applications are also possible, while still retaining the benefits of the present invention.

What is claimed is:

1. A container comprising:

a base having a floor;

a first wall generally perpendicular to the floor when in an assembled orientation;

a second wall generally perpendicular to the floor and the first wall when in the assembled orientation; and a latch integrally molded with the first wall for selectively connecting the first wall to the second wall, the latch including an outer release surface disposed outwardly of the second wall, an inner release surface disposed inwardly of the second wall, and a second inner release surface disposed inwardly and adjacent the second wall, where the latch is configured to selectively disconnect the first wall from the second wall upon actuation of the outer release surface, and where the latch is configured to selectively disconnect the first wall from the second wall upon an application of force to the inner release surface, and where the latch is configured to selectively disconnect the first wall from the second wall upon force inwardly-directed upon the second wall sufficient to flex the latch away from the second wall by engagement of the second wall against the second inner release surface to release the second wall.

2. The container of claim 1 wherein the latch includes a recess into which a portion of the second wall is received when the latch is connected to the second wall.

3. The container of claim 2 wherein the outer release surface is positioned outward of the recess and the inner release surface is positioned inward of the recess.

4. The container of claim 2 wherein the second wall includes a portion of reduced thickness received within the recess.

5. The container of claim 4, wherein the second inner release surface cooperates with the portion of reduced thickness when the first and second walls disconnect in response to the force inwardly-directed upon the second wall.

6. The container of claim 4 wherein the second wall includes a recess on an outer surface of the second wall near the portion of reduced thickness of the second wall, and wherein the outer release surface is accessible within the recess on the outer surface of the second wall.

7. The container of claim 1 wherein the second inner release surface is opposite the inner release surface.

8. The container of claim 7 wherein the second inner release surface is angled.

9. The container of claim 1 wherein the latch is flexible away from the second wall in order to disconnect the second wall from the latch.

10. The container of claim 1 wherein the first and second walls are connected by hinges to the base and selectively movable between a collapsed position generally parallel to the floor and a use position generally perpendicular to the floor.

11. The container of claim 1 wherein the first and second walls include interlocking tabs.

12. The container of claim 1, wherein the interlocking tabs are offset from a lateral edge of the first wall.

13. The container of claim 1 wherein one of the first wall and second wall includes a post positioned outwardly of latch for preventing excessive outward deflection of the latch.

14. The container of claim 1 wherein the second inner release surface faces the second wall when in the assembled orientation.

15. The container of claim 14 wherein the second wall includes a portion of reduced thickness received within a recess formed within the latch, the portion of reduced thickness having a tapered surface to engage the second inner release surface in response to the force inwardly-directed upon the second wall.

16. The container of claim 15 wherein the inner release surface is obliquely orientated relative to an inner surface of the first wall, and wherein the second inner release surface is obliquely orientated relative to the inner surface of the first wall and obliquely orientated relative to the inner release surface.

17. A collapsible container comprising:

a floor;

a first wall movable about a first hinge between a collapsed position generally parallel to the floor and a use position generally perpendicular to the floor;

a second wall movable about a second hinge between a collapsed position generally parallel to the floor and a use position generally perpendicular to the floor; and a latch integrally molded with the first wall for selectively connecting the first wall to the second wall while the first and second walls are in the use position, the latch configured to be selectively disconnected upon the application of force from outside the collapsible container by actuation of a latch member and wherein the latch is configured to be selectively disconnected by an application of an inwardly directed force on the second wall, and wherein the latch member comprises an outer release surface positioned outwardly of the second wall and wherein the latch includes an inner release surface that faces the second wall when in an assembled orientation, wherein the inner release surface reacts against the second wall in response to the application of the inwardly directed force on the second wall.

18. The collapsible container of claim 17 wherein the latch is configured to selectively disconnect the latch from the second wall upon manual actuation of the outer release surface.

19. The collapsible container of claim 18 wherein the latch includes a recess into which a portion of the second wall fits when the latch is connected to the second wall.

20. The collapsible container of claim 19 wherein the outer release surface is positioned outward of the recess.

21. The collapsible container of claim 17 wherein the second wall includes a portion of reduced thickness received within a recess formed within the latch, the portion of reduced thickness having a tapered surface to engage the inner release surface in response to the inwardly-directed force on the second wall.

22. The collapsible container of claim 21 wherein the inner release surface comprises a first inner release surface that is obliquely orientated relative to an inner surface of the first wall, and wherein the latch includes a second inner release surface facing away from the first inner release surface, the second inner release surface being obliquely orientated relative to the inner surface of the first wall and obliquely orientated relative to the first inner release surface, and wherein the latch is configured to selectively disconnect the first wall from the second wall upon application of force to the second inner release surface.

23. A collapsible container comprising:

a floor;

a first wall movable about a first hinge between a collapsed position generally parallel to the floor and a use position generally perpendicular to the floor;

a second wall movable about a second hinge between a collapsed position generally parallel to the floor and a use position generally perpendicular to the floor; and a latch integrally molded with the first wall for selectively connecting the first wall to the second wall while the first and second walls are in the use position, the latch configured to be selectively disconnected upon the application of force from inside the collapsible container by actuation of a latch member and wherein the latch is configured to be selectively disconnected by an application of an inwardly directed force on the second wall, and wherein the latch member comprises a first inner release surface facing inwardly away from the second wall and wherein the latch includes a second inner release surface that faces the second wall when in an assembled orientation, and wherein the second inner release surface reacts against the second wall in response to the application of the inwardly directed force on the second wall.

24. The collapsible container of claim 23 wherein the second wall includes a portion of reduced thickness received within a recess formed within the latch, the portion of reduced thickness having a tapered surface to engage the second inner release surface in response to the inwardly-directed force on the second wall.

25. The collapsible container of claim 24 wherein the first inner release surface is obliquely orientated relative to an inner surface of the first wall, and wherein the second inner release surface is obliquely orientated relative to the inner surface of the first wall and is obliquely orientated relative to the first inner release surface.

26. The collapsible container of claim 23 wherein the latch includes an outer release surface that is positioned outwardly of the second wall, and wherein the latch is selectively configured to disconnect the first and second walls from each other upon an application of force to the outer release surface.

* * * * *